US007665874B2

(12) United States Patent
Chadwell et al.

(10) Patent No.: US 7,665,874 B2
(45) Date of Patent: Feb. 23, 2010

(54) METHOD AND APPARATUS FOR DELIVERING VISUAL INFORMATION

(76) Inventors: Thomas J. Chadwell, 2406 Old Well Dr., San Antonio, TX (US) 78259; Michael T. Romanyszyn, 3720 Running Springs, San Antonio, TX (US) 78261; John Vira, 326 Hackberry, Lockhart, TX (US) 78644

( * ) Notice: Subject to any disclaimer, the term of this patent is extended or adjusted under 35 U.S.C. 154(b) by 122 days.

(21) Appl. No.: 11/731,417

(22) Filed: Mar. 30, 2007

(65) Prior Publication Data

US 2008/0236006 A1 Oct. 2, 2008

(51) Int. Cl.
*G09F 9/00* (2006.01)

(52) U.S. Cl. ..... 362/561; 362/559; 362/812; 40/448

(58) Field of Classification Search ..... 362/231, 362/559, 249, 812, 561; 40/442, 444, 452, 40/546, 547, 564, 541, 581, 448; 340/815.54, 340/815.55

See application file for complete search history.

(56) References Cited

U.S. PATENT DOCUMENTS 5,151,679 A * 9/1992 Dimmick ..... 340/326
6,237,290 B1 * 5/2001 Tokimoto et al. ..... 52/236.3
6,539,656 B2 * 4/2003 Maas et al. ..... 40/546
6,874,922 B2 * 4/2005 Matsuura et al. ..... 362/497
6,997,592 B2 * 2/2006 Jeon ..... 362/561
7,220,019 B2 * 5/2007 Cheung et al. ..... 362/235
2003/0046838 A1 * 3/2003 O'Connell, Jr. ..... 40/452
2006/0215958 A1 * 9/2006 Yeo et al. ..... 385/31
2007/0230170 A1 * 10/2007 Mita et al. ..... 362/231

* cited by examiner

*Primary Examiner*—Jong-Suk (James) Lee
*Assistant Examiner*—Peggy A. Neils
(74) *Attorney, Agent, or Firm*—John Vira

(57) ABSTRACT

An information display device illuminates a light pipe, and includes a controller to regulate the power levels delivered to a light source, thereby regulating the amount of light delivered to the light pipe. Alternatively, the information display device delivers visual data, including alpha-numeric characters, predetermined images, or a controlled phasing. The information display device may be utilized to illuminate information associated with the structure. The illumination system provides the ability to phase between different colors, as well as blended colors. Accordingly, an information display device phases between varying colors, and may blend colors to create color schemes. The illumination system includes a control module disposed within the structure to control device parameters. The illumination system further includes landscape lights that are in communication with the control module and the information display device, such that the landscape lights may phase with the information display device, thereby providing a unified phasing effect.

21 Claims, 38 Drawing Sheets

METHOD AND APPARATUS FOR DELIVERING VISUAL INFORMATION

BACKGROUND OF THE INVENTION

1. Field of the Invention

The present invention relates to illumination equipment and, more particularly, but not by way of limitation, to methods and an apparatus for delivering visual information.

2. Description of the Related Art

While the delivery of visual information may seem commonplace, the effectiveness of visual information delivered depends on many factors, including clarity, text sizes, lighting conditions, and the like. Additionally, the unavailability of commercial products for particular tasks may further limit the delivery of visual information in those areas.

Illustratively, in the areas of residential lighting, unlit numerals are readily available and commonly utilized. Lighted numerals are not readily available, as hardware for lighted address devices is more expensive because outdoor equipment must be able to endure harsh weather conditions for extended periods. Further setbacks include the added expense of outdoor wiring to peripheral equipment. Often, the outdoor lighting equipment is an additional expense that may not be a priority for most homeowners. As such, a majority of residences remain unlit at night.

Residences that do have lighting systems typically utilize landscape lights to outline a sidewalk or garden area, and not the house numerals. Problems arise when the residence numerals are unevenly lit causing shadow problems or partial illumination, thereby delivering incorrect information. Often, the structures are disposed at increased distances from a roadway, and therefore, problems arise for those individuals attempting to locate a particular structure. During dark periods, such as night, early morning, foggy and rainy days, the location problems are magnified, as most times, the only lighting available to individuals in a vehicle is vehicle lighting that points predominantly forward. As such, persons looking for a certain household must find address numerals, and must traverse semi-familiar to unfamiliar streets in their attempt to locate the dark address demarcation.

In a second example, a billboard that is not illuminated may deliver visual information only during daylight hours.

Accordingly, an illumination system that delivers clear, crisp, illuminated visual information would be beneficial to viewers, as well as the persons displaying the visual information.

SUMMARY OF THE INVENTION

In accordance with the present invention, an information display device includes a light source that projects light through a light pipe. The information display device may utilize virtually any form of light source to illuminate the light pipe, and includes a controller to regulate the power levels delivered to the light source, thereby regulating the amount of light delivered to the light pipe. The light pipe is then masked through the use of an information filter, thereby delivering visual information to a viewer.

In a second embodiment, the information display device is configured in a self-contained unit, and delivers visual data, including alpha-numeric characters or predetermined images, or a controlled phasing.

In a third embodiment, a structure illumination system provides a means for illuminating information associated with the structure or the inhabitants of the structure. The illumination system provides the ability to phase between different colors, as well as blended colors. Accordingly, an information display device phases between varying colors, and may blend colors to create color schemes.

In a fourth embodiment, the illumination system includes a control module disposed within the structure, such that the inhabitants of the structure have access to the control module, and may control the phasing colors, scheme, or may press an emergency input button to override the phasing routine, and commence a flashing routine. Accordingly, the illumination system may provide a color hold, a partial phase, a full color spectrum phase, an emergency flash, and the like.

In a fifth embodiment, the illumination system further includes landscape lights that are in communication with the control module and the information display device, such that the landscape lights may phase with the information display device, thereby providing a unified phasing effect.

It is therefore an object of the present invention to provide a device that delivers visual information.

It is therefore further an object of the present invention to provide a structure illumination system.

It is a still further object of the present invention to provide a means for notifying persons within a viewing distance of a structure of an emergency situation within a structure.

It is still yet further an object of the present invention to provide a residential illumination system that phases through blended light schemes.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

BRIEF DESCRIPTION OF THE DRAWINGS

FIG. 1I provides a perspective view of the information display device utilizing a hybrid information filter according to another extension of the first embodiment.

DETAILED DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

Figure 1A:
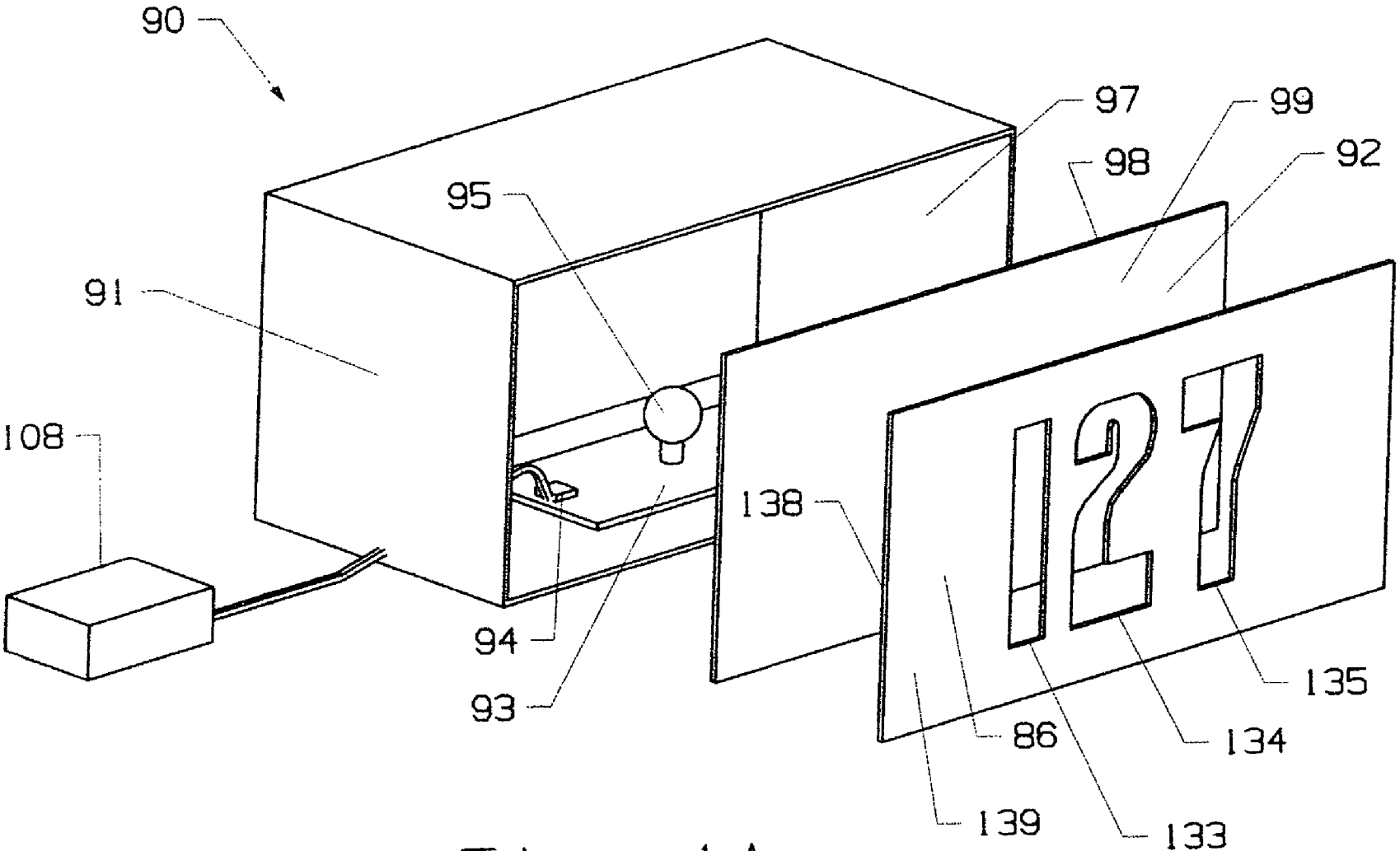
FIG. 1A provides a perspective view of an information display device according to a first embodiment.

In a simplest form, an information display device 90 illuminates a light pipe 92 in a controlled fashion and color scheme. As shown in FIG. 1A, the information display device 90 includes a housing 91, the light pipe 92, a light source 95, and a control board assembly 93. In this simplest form, the housing 91 is box shaped and includes a chamber 97 that is open on one end. The shape of the housing 91 is conducive to protecting the components of the information display device 90, and may be formed from any suitable structural material, including injection molded plastics, formed metals, and the like. In this embodiment, the housing 91 is formed from a resin. Illustratively, the housing 91 is formed from acetal butyl styrene.

The light pipe 92 is of a rectangular shape, and is constructed from substantially any translucent material. In this embodiment, the light pipe 92 is constructed from an acrylic, and includes a receiving surface 98, and an emitting surface 99. The light pipe 92 has a stiffness sufficient to stand on end, and is of a size complementary to the opening of the housing 91, such that the light pipe 92 may cover the opening of the housing 91. In this specific example, the receiving surface 98 is etched to provide increased light diffusion within the light pipe 92. The light pipe 92 is disposed adjacent to the housing 91. While this embodiment has been shown with a receiving surface 98 having an etched surface, one of ordinary skill in the art will recognize that other forms of diffusion are possible, and therefore should be construed as part of this invention.

The first light source 95 may be any form of light source, including light emitting diodes, incandescent bulbs, fluorescent bulbs, and the like. In this embodiment, the light source 95 is an incandescent bulb of a color. Selection of the color of the light source 95 may be based on a desired light color output. Illustratively, a school having school colors of red and blue may utilize a light source 95 that outputs a red or blue light. In this arrangement, the light source 95 may be powered at varying levels to deliver a red or blue light of a varying intensity.

Figure 1B:
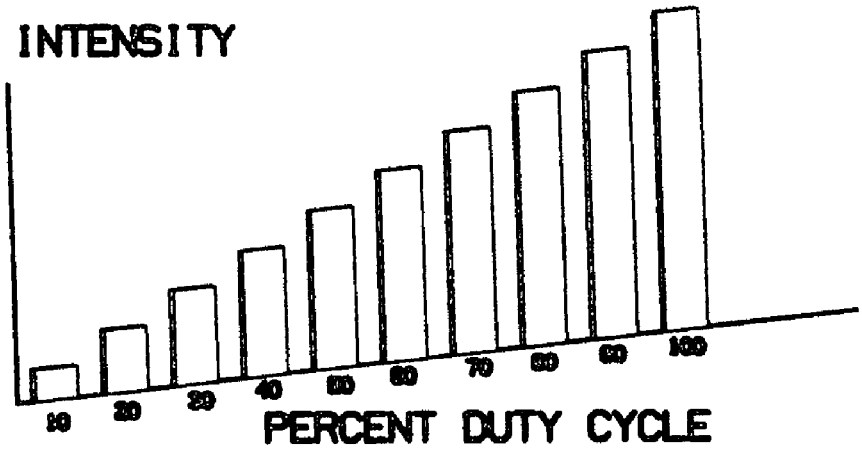
FIG. 1B provides bar graph providing an example of varying power levels according to the first embodiment.
Figure 1C:
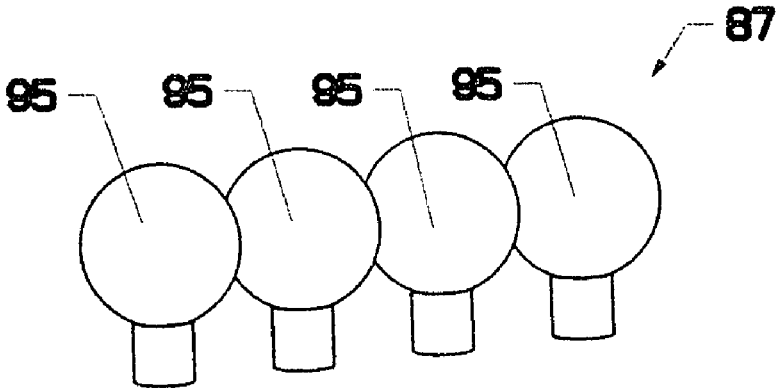
FIG. 1C provides an example of a light bank having a single color light source according to the first embodiment.

The control board assembly 93 includes a controller 94, and hardware suitable for connection to the light source 95. The control board assembly 93 fits within the housing 91, such that controller 94 may be in electrical communication with the light source 95. Alternatively, the information display device 90 includes a light bank 87 of light sources 95. The light bank 87 is constructed by placing a repeating pattern of light sources 95 in a line or other pattern, and may be as long as can be accommodated within the housing 91. Illustratively, in this simplest embodiment, the light bank 87 is a series of same color light sources, as shown in FIG. 1C.

The controller 94 may be any form of processing device commonly utilized in electronic circuitry, and is in electrical communication with the light source 95 and a power source 108. The controller 94 regulates the power level applied to the light sources 95, and may further include a real-time clocking mechanism for scheduling routines.

The power source 108 may be any form of remote power source, including batteries or solar cells. Alternatively, the information display device 90 may be in communication with a remote direct current or converted alternating current source. In this embodiment, the power source 108 is a remote converted alternating current source that supplies power to the information display device 90 through a power cord.

In use, when the light sources 95 are powered, emitted light passes through the receiving surface 98 and illuminates the light pipe 92 with direct and refracted light. The light then exits the light pipe 92 through the emitting surface 99, and is then visible from a front of the information display device 90.

In this first embodiment, the information display device 90 executes a phasing sequence within the color spectrum of the light source 95, thereby moving from a "full power," or brightest light, to a "no power", or weakest light, by applying progressive levels of pulse width modulation to the first light source 95. One of ordinary skill in the art will recognize that reversing the process to is attainable, and should be considered part of this invention. As shown in FIG. 1B, the sequencing trend may move from zero percent to one hundred percent at intervals of ten percent.

While this example has been shown with concrete data points, one of ordinary skill in the art will recognize that the data points merely are exemplary of a trend, and that the power variable may be broken down into virtually any number of power level segments. Illustratively, a power level broken into one hundred segments may be applied with any number of segments between zero and one hundred. Alternatively, the power level may be divided into a greater number of segments to produce a gradual transition. One of ordinary skill in the art will further recognize that a timing function is also required, wherein the time increment or duration may be lengthened to deliver a gradual transition or shortened to deliver a faster transition.

The information display device 90 further includes an information filter 86. The information filter 86 is of a rectangular shape, and of a size complementary to the light pipe 92, such that the information filter 86 covers the emitting surface 99 of the light pipe 92. The information filter 86 is constructed from an opaque material, such as plastics, foils, cardboards, metals, and the like. In this particular example, the information filter 86 is static, and includes at least one information port 133 passing from a first side 138 to a second side 139 of the information filter 86. The information port 133 may be of virtually any shape or form that provides a distinguishable icon or part of an icon, including letters of the alphabet, numerals, logos, and the like. The information filter 86 may further include additional information ports, wherein the multiple information ports are located at a predetermined spacing or orientation to create an object, logo, address label, words, or the like. Illustratively, the first information port 133 may be in a shape of a numeral "1," a second information port 134 may be in a shape of a numeral "2," and a third information port 135 may be in the shape of a numeral "7," thereby denoting an address of "127." Still further, the first information port 133 may be in the shape of a school logo, and may therefore project a school logo, or multiple information ports may be combined to form the same school logo.

Figure 1D:
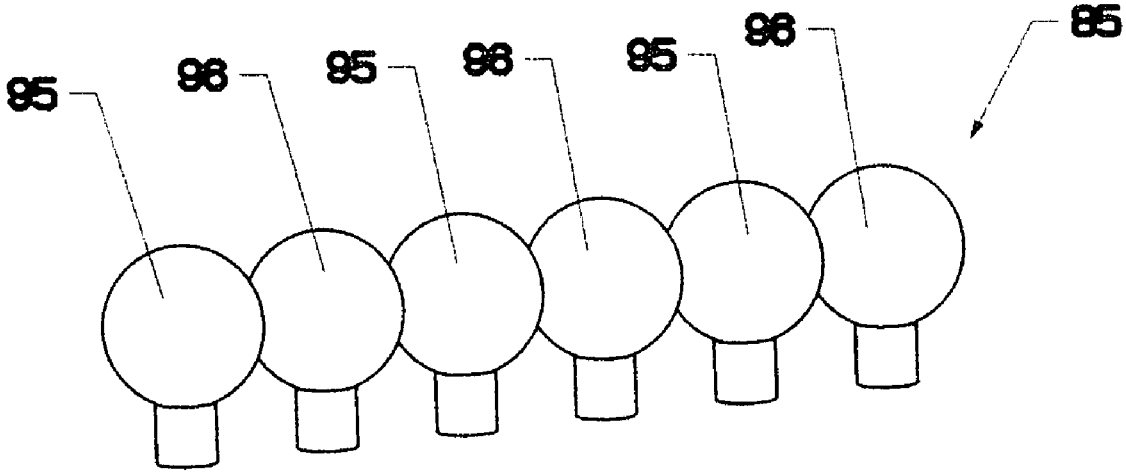
FIG. 1D provides an example of a light bank having multiple color light sources according to an extension of the first embodiment.
Figure 1E:
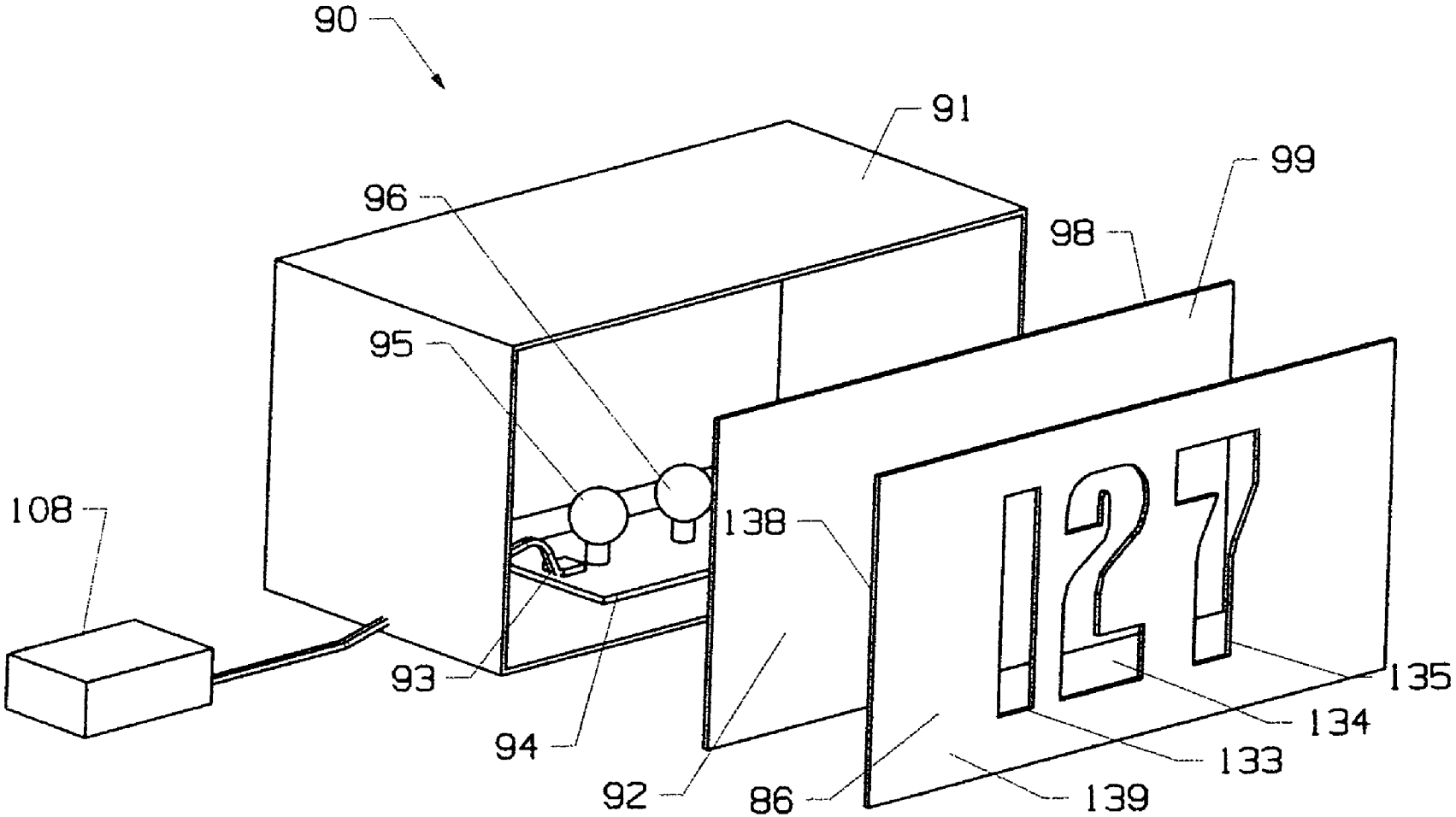
FIG. 1E provide a perspective view of an information display device including two different color light sources according to the extension of the first embodiment.

In an extension of the simplest embodiment, the information display device 90 may further include a second light source 96 of a second color. In this extension, the first light source 95 is an incandescent bulb of a first color, and the second light source 96 is an incandescent bulb of a second color, as shown in FIG. 1E. Selection of the colors of the first light source 95 and the second light source 96 may be based on a desired light color output. Illustratively, a school having school colors of red and blue may utilize a first light source 95 that outputs a red light, and a second light source 96 that outputs a blue light. In this arrangement, the first light source 95 may be powered to deliver a red light, the second light source 96 may be powered to deliver a blue light, or the first light source 95 and the second light source 96 may be powered at varying levels to deliver a blended light. Alternatively, the information display device 90 may phase from the red light to the blue light, and from the blue light to the red light.

The control board assembly 93 includes the controller 94, and hardware suitable for connection to the first light source 95 and the second light source 96. The control board assembly 93 fits within the housing 91, such that controller 94 may be in electrical communication with the first and second light sources 95 and 96. Alternatively, the control board assembly 93 includes a light bank 85 of light sources. The light bank 85 is constructed by placing a repeating pattern of light sources in a line, and may be as long as can be accommodated within the housing 91. Illustratively, in this extension of the simplest embodiment, the light bank 85 is a repeating pattern of light sources of different colors, as shown in FIG. 1D.

The controller 94 may be any form of processing device commonly utilized in electronic circuitry, and is in electrical communication with the first light source 95, the second light source 96, and the power source 108. The controller 94 regulates the power level applied to the light sources 95 and 96. The controller 94 may further include a real-time clocking mechanism for scheduling routines.

In use, when the light sources 95 and 96 are powered, the emitted light passes through the receiving surface 98 and illuminates the light pipe 92 with direct and refracted light. The light then exits the light pipe 92 through the emitting surface 99, and is then visible from a front of the information display device 90. In cases where an information filter 86 is utilized, the illuminated light pipe 102 is visible through the information ports 131-133 in the shape of the information ports 131 through 133.

Figure 2A:
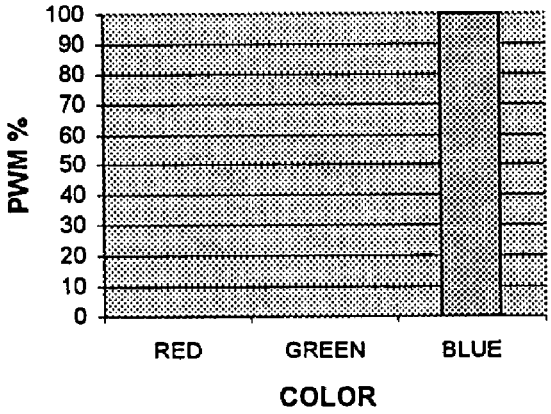
FIG. 2A through 2E provide a sample power level profile for steps of a sample two-color phase trend according to the first embodiment.
Figure 2B:
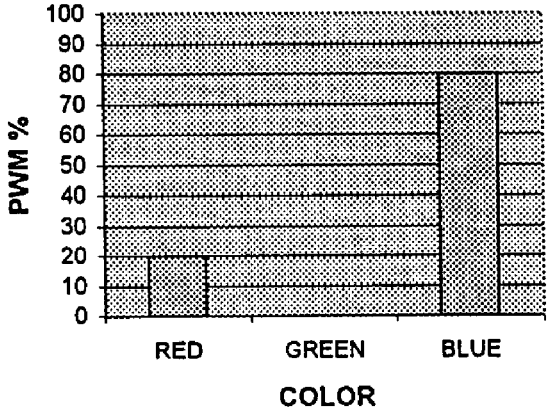
Figure 2C:
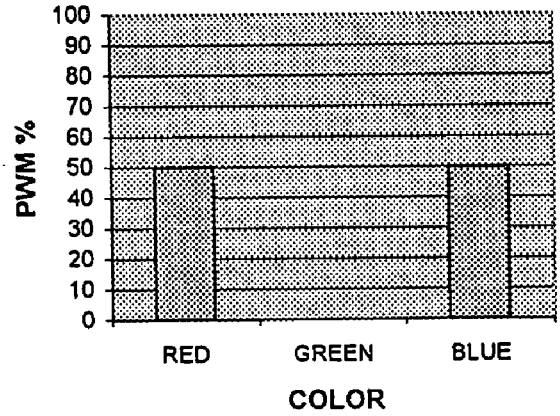
Figure 2D:
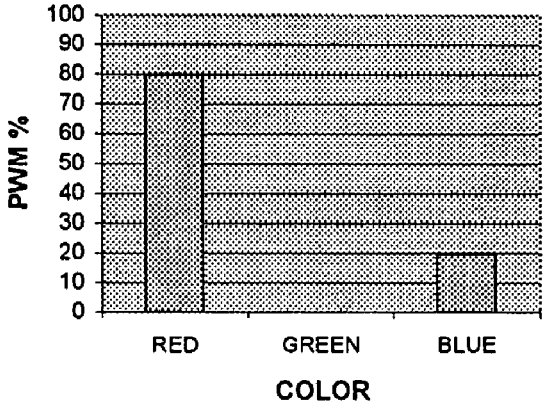

In this extension of the simplest embodiment, the information display device 90 executes a phasing sequence, wherein the controller 94 applies progressive levels of pulse width modulation to the first light source 95 and the second light source 96 to gradually transition from illuminating the information display device 90 in the first color, blending from a predominantly first color to an evenly blended color, to a blended predominantly second color, and to illuminating the information display device 90 in the second color, and possibly reversing the process. As shown in FIGS. 2A through 2E, the sequencing trend for transitioning between two colors may start with a first light source 95 that emits a blue light, and a second light source 96 that emits a red light. FIG. 2A illustrates a first trend point wherein the first light source 95 is powered at one hundred percent, and the second light source 96 is not powered, thereby delivering a blue light to the information display device 90. The second trend point shown in FIG. 2B illustrates the first light source 95 powered at eighty percent and the second light source 96 powered at twenty percent, thereby delivering a mixed light. The third trend point is shown in FIG. 2C, and shows first light source 95 and the second light source 96 powered equally at fifty percent, thereby delivering a (red/blue) light to the light pipe 92. The trend continues with the powering scheme disclose in FIG. 2D, wherein the second light source 96 is powered at eighty percent and the first light source 95 is powered at twenty percent, thereby displaying a predominantly red color.

Figure 2E:
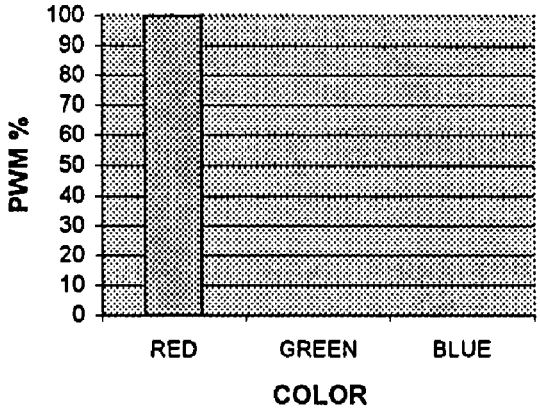
Figure 2F:
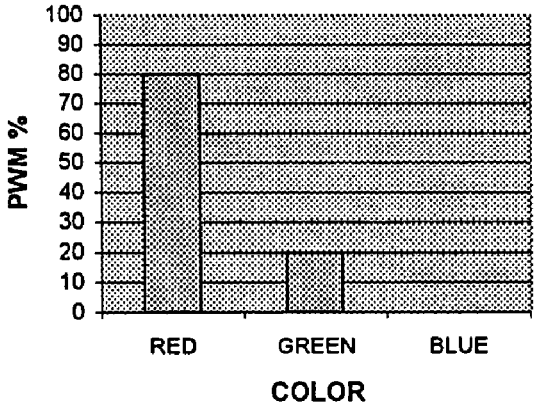
FIG. 2F through 2M provide a sample power level profile for steps of a sample three-color phase trend according to the first embodiment.
Figure 2G:
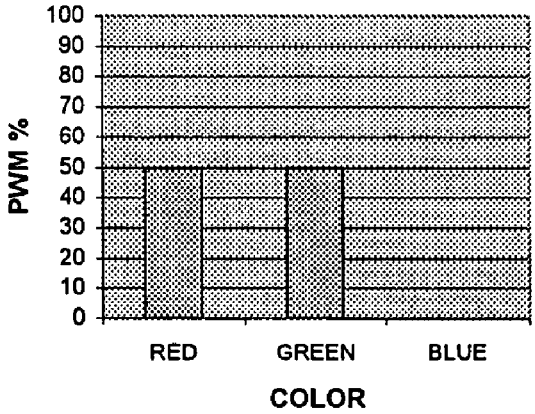

In the next trend point, FIG. 2E, the second light source 96 is powered at one hundred percent, thereby illuminating the information display device 90 in a red color. The process continues with the return to the state described in FIG. 2D, wherein the power to the second light source 96 is decreased to eighty percent, and the power to the first light source 95 is increased to twenty percent. The controller continues to the state previously described in FIG. 2C, wherein the first light source 95 and the second light source 96 are powered equally, thereby displaying a mixture of red and blue light. The trend continues by decreasing the power level of the second light source 96 to twenty percent, and increasing the power level of the first light source 95 to eighty percent, as shown in FIG. 2B. The controller then moves to the state associated with FIG. 2A, wherein a blue light is delivered to the information display device 90, and recommences the sequence.

While this example has been shown with concrete data points, one of ordinary skill in the art will recognize that the data points merely are exemplary of a trend, and that the power variable may be broken down into virtually any number of power level segments. Illustratively, a power level broken into one hundred segments may be applied with any number of segments between zero and one hundred. Alternatively, the power level may be divided into a greater number of segments to produce a gradual transition. One of ordinary skill in the art will further recognize that a timing function is also required, wherein the time increment or duration may be lengthened to deliver a gradual transition or shortened to deliver a faster transition.

It should be clear to one of ordinary skill in the art that this example is only one of many derivatives that may create a phasing sequence that may produce similar effects. It should also be clear to one of ordinary skill in the art that this example is not limiting in scope, as the colors may change, the power values may be altered, and the timing sequence may be altered to produce a similar effect.

Figure 1F:
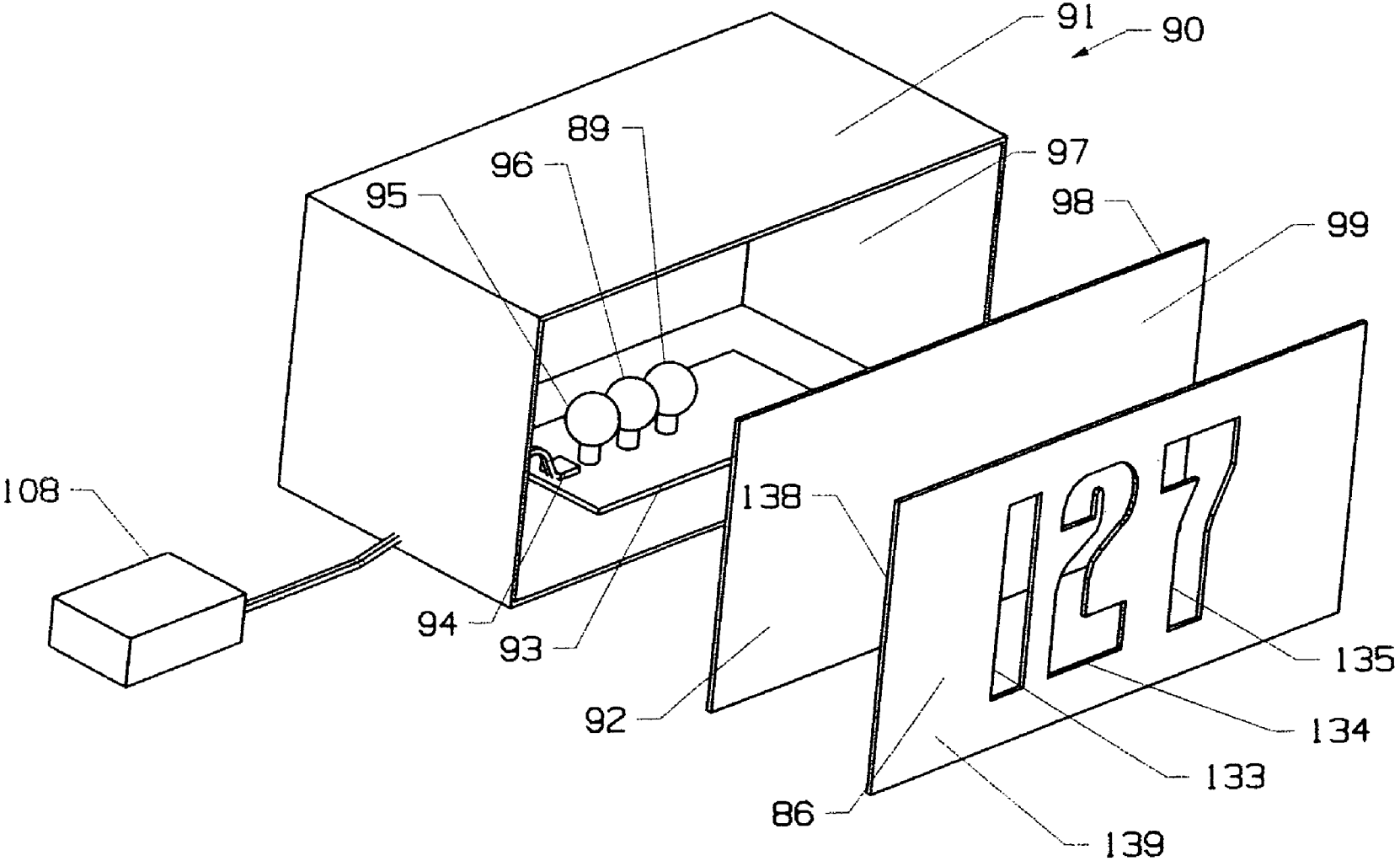
FIG. 1F provide a perspective view of an information display device including three different color light sources according to the extension of the first embodiment.

While this embodiment has been shown with a first light source 95 and a second light source 96, one of ordinary skill in the art will recognize that larger quantities of light sources may be utilized to broaden the range of colors available. Illustratively, a third light source 89 having a third color may be utilized to add an additional color spectrum, or to create a color not available as a light source, as shown in FIG. 1F. In this case, a light bank repeats a pattern of the three light sources to provide an even lighting across the light pipe 92.

One of ordinary skill in the art will further recognize that phasing through a full color spectrum may be achieved if light sources of the three primary colors are utilized. Illustratively, a light source emitting a red light, a light source emitting a blue light, and light source emitting a green light would be required in the information display device 90. All possible colors of the color pallet are assigned a digital number, and the controller 94 then scrolls through the digital numbers, thereby phasing through the entire color spectrum. One of ordinary skill in the art will still further recognize that the controller 94 may be able to scroll through a desired partial spectrum, or even a single color with varying intensity.

Figure 2H:
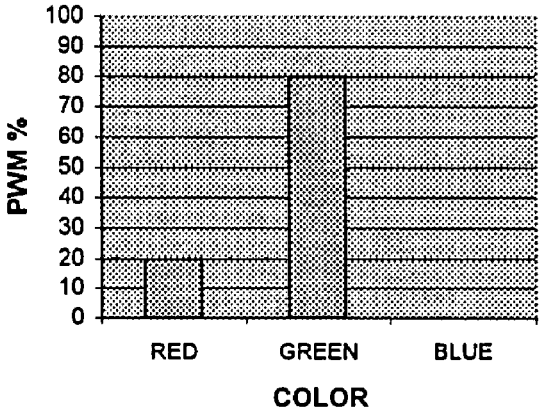
Figure 2I:
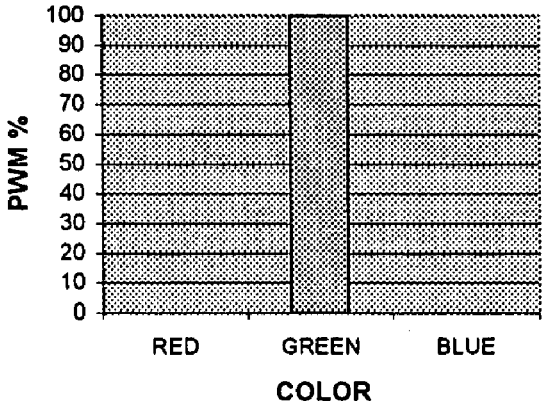

Illustratively, a three light source phasing scheme containing the three primary colors commences with the previously disclosed state charts shown in FIGS. 2A through 2E, and further encompasses FIGS. 2F through 2M. After the controller 94 executes the steps shown and described in FIGS. 2A through 2E, the controller 94 adjusts the power levels to those shown in FIG. 2F, wherein the power level of the second light source 96 is decreased to eighty percent, and a power level for the third light source 89 is increased to twenty percent, thereby delivering a blended light to the light pipe 92. The controller 94 continues the trend by moving to a state described in FIG. 2G, wherein the second light source 96 and the third light source 89 are powered equally, thereby delivering a blended light to the light pipe 92. The next trend point is shown in FIG. 2H, wherein power to the second light source 96 is decreased to twenty percent, and the power to the third light source 89 is increased to eighty percent. The controller 94 then moves to conditions shown in FIG. 2I, wherein power to the second light source 96 is ceased, and the power to the third light source 89 is elevated to one hundred percent, thereby illuminating the light pipe 92 in a green color.

Figure 2J:
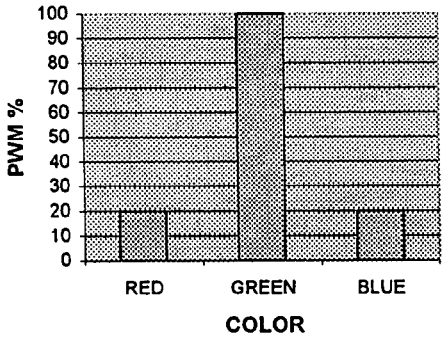
Figure 2K:
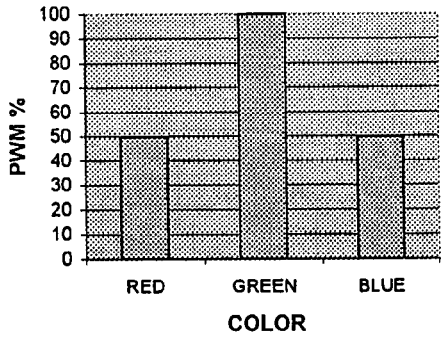
Figure 2L:
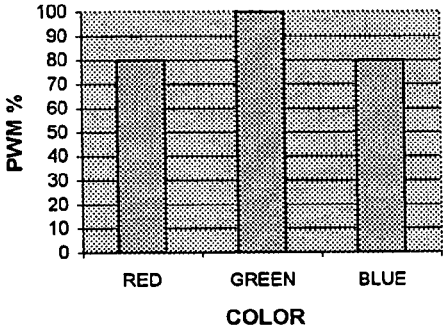
Figure 2M:
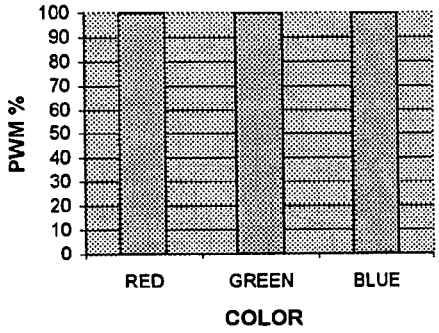

The controller 94 then moves to a state described in FIG. 2J, wherein all three of the light sources 95, 96, and 89 are at least partially powered. In this example, the state described in FIG. 2J provides for full power to the third light source 89, and twenty percent power to the first light source 95 and the second light source 96, thereby delivering a blended light to the light pipe 92. The controller 94 continues the trend by increasing the power levels of the first light source 95 and the second light source 96, as shown in FIG. 2K, and then FIG. 2L. The trend continues with the controller 94 increasing the power levels of the first and second light sources 95 and 96 to full power, as described in FIG. 2M, thereby delivering a blended light to the light pipe 92.

One of ordinary skill in the art will readily recognize that this example may be continued, recommenced, or phased to either of the other light sources 95, 96, and 89. One of ordinary skill in the art will further recognize that this example is merely a small sample of the range of colors and color mixes possible in this invention, and that the number of light sources may be increased to or decreased dependent upon applications.

Figure 1G:
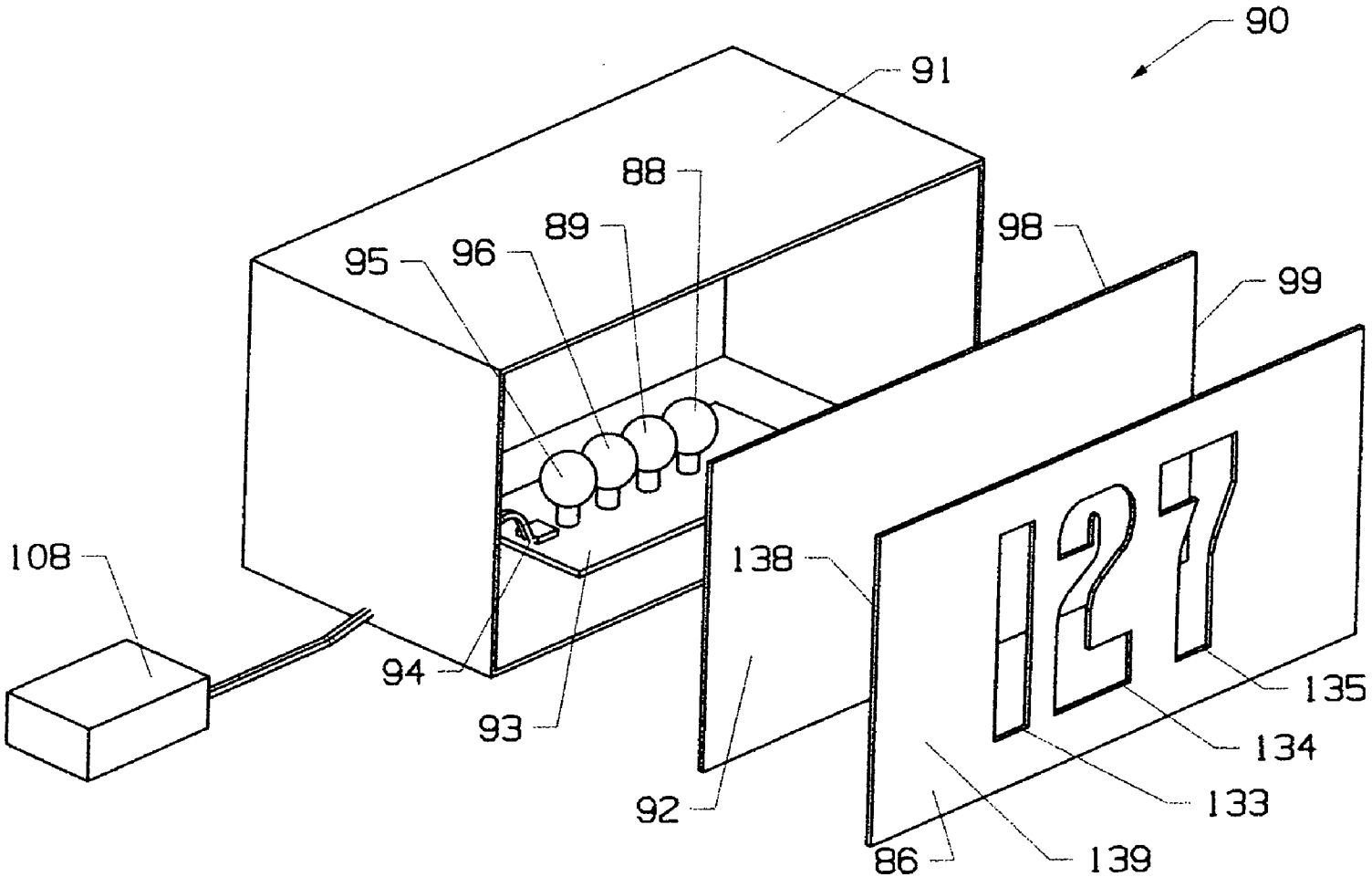
FIG. 1G provide a perspective view of an information display device including a booster light source in combination with three color sources according to the extension of the first embodiment.

As shown in FIG. 1G, the information display device 90 may further include a booster light source 88 to increase the intensity of the information display device 90. The booster light source 88 emits a white light that complements the other light sources, and may be disposed as part of the repeating pattern of light source colors in the light bank. Illustratively, the previously disclosed light pattern of a red, blue, red, blue, . . . , would then be: red, blue, white, red, blue, white, . . . etc.

In use, the information display device 90 continuously illuminates the light pipe 92 in varying shades of pre-selected colors, thereby displaying the illuminated light pipe 92. The information display device 90 may be used as a decoration, an informative device, or even a novelty item. In cases where an information filter 86 is utilized, the illuminated light pipe 102 is visible through the information ports 131-133 in the shape of the information ports 131-133.

Figure 1H:
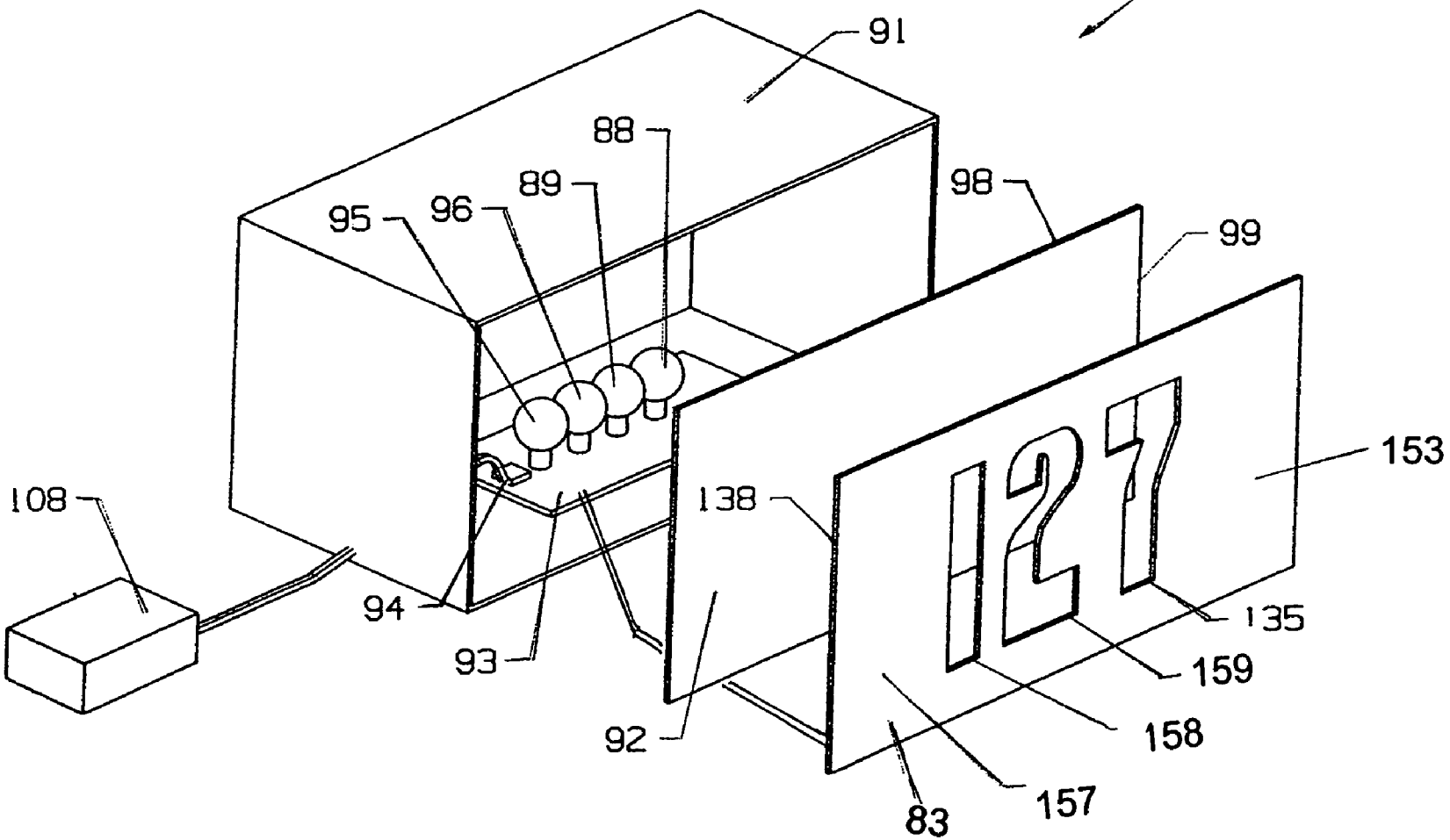
FIG. 1H provides a perspective view of the information display device utilizing a dynamic information filter according to an extension of the first embodiment.
Figure 11:
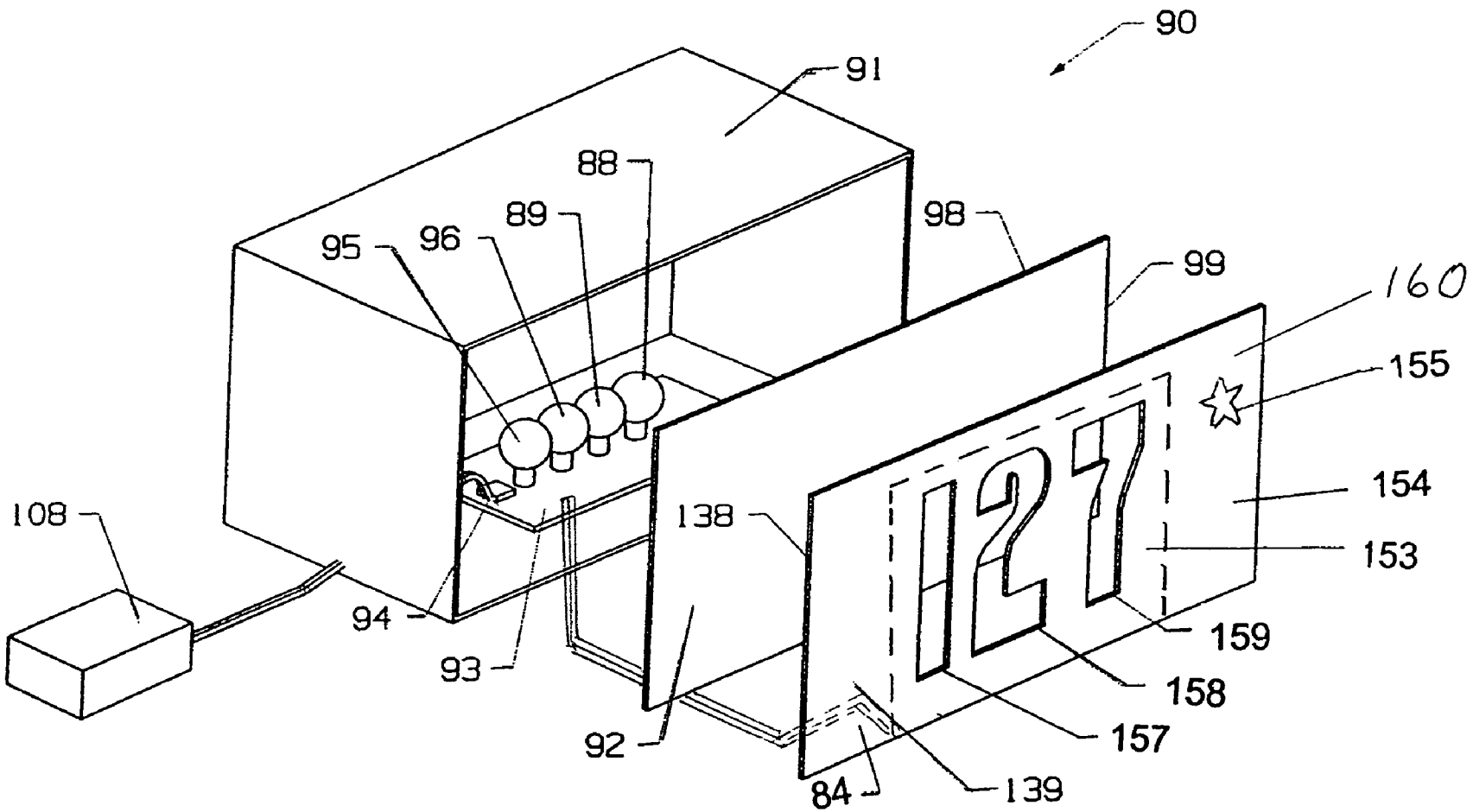

Alternatively, the information display device 90 may be employed with a dynamic information filter 83, as shown in FIG. 1H. The dynamic information filter 83 is similar in form to the static information filter 86, however, the dynamic information filter 83 includes an active panel in electrical communication with the controller 94. In this specific example, the active panel includes a liquid crystal display panel for delivering visual information. An active portion 153 includes information cells 157-159 that deliver visual information when the information cells 157-159 are activated. In this extension of the first embodiment, the dynamic information filter 83 is of a size complementary to the light pipe 92. The controller 94 activates the information cells 157-159 to allow light from the light pipe 92 to pass through the information cells 157-159. As with the use of the information filter 86 of the first embodiment, the size, shape, and orientation of the information cells 157-159 facilitates the delivery of visual information to viewers.

In operation, the information filter 83 is opaque when not energized, and the information cells 157-159 are translucent when energized, thereby allowing the light from the light pipe 92 to pass through the information cells 157-159 to deliver visual information to viewers. All other aspects of this extension of the first embodiment are identical to the first embodiment. Illustratively, an active information filter 83 may be utilized with phasing, flashing, and the like.

In an extension of the alternative embodiment, the information display device 90 may utilize a hybrid information filter 84 having an active portion 153 and an inactive portion 154. In this specific example, the active portion 153 includes a suitable active display device such as the liquid crystal display panel. In this embodiment, the inactive portion 154 is covered by a partial information filter 160 of a shape complementary to the inactive portion 154. The partial information filter 160 may include at least one inactive information port 155, as shown in FIG. 1I. The active portion 153 is in electrical communication with the controller 94, and is activated by the controller 94 to deliver visual information to viewers through the use of the information cells 157-159 described in the active information filter 83. The inactive information port 155 is illuminated when the light pipe 92 is illuminated.

In operation, the controller 94 controls the activation of the information cells 157-159 of the active portion 153, and also controls the illumination of the light pipe 92, thereby illuminating the information port 155. While this embodiment has been shown with an active portion 153, and an inactive portion 154 having a partial information filter 160, one of ordinary skill in the art will recognize that virtually any size active portion 153 may be utilized without a partial information filter 160, thereby allowing the light pipe 92 to be illuminated around the portions of the emitting surface 99 not covered by the active portion 153. Illustratively, the emitting surface 99 not covered by the active portion 153 may be visible during a phase routine, or the like, and the active portion 153 may simultaneously deliver visual information.

Figure 3A:
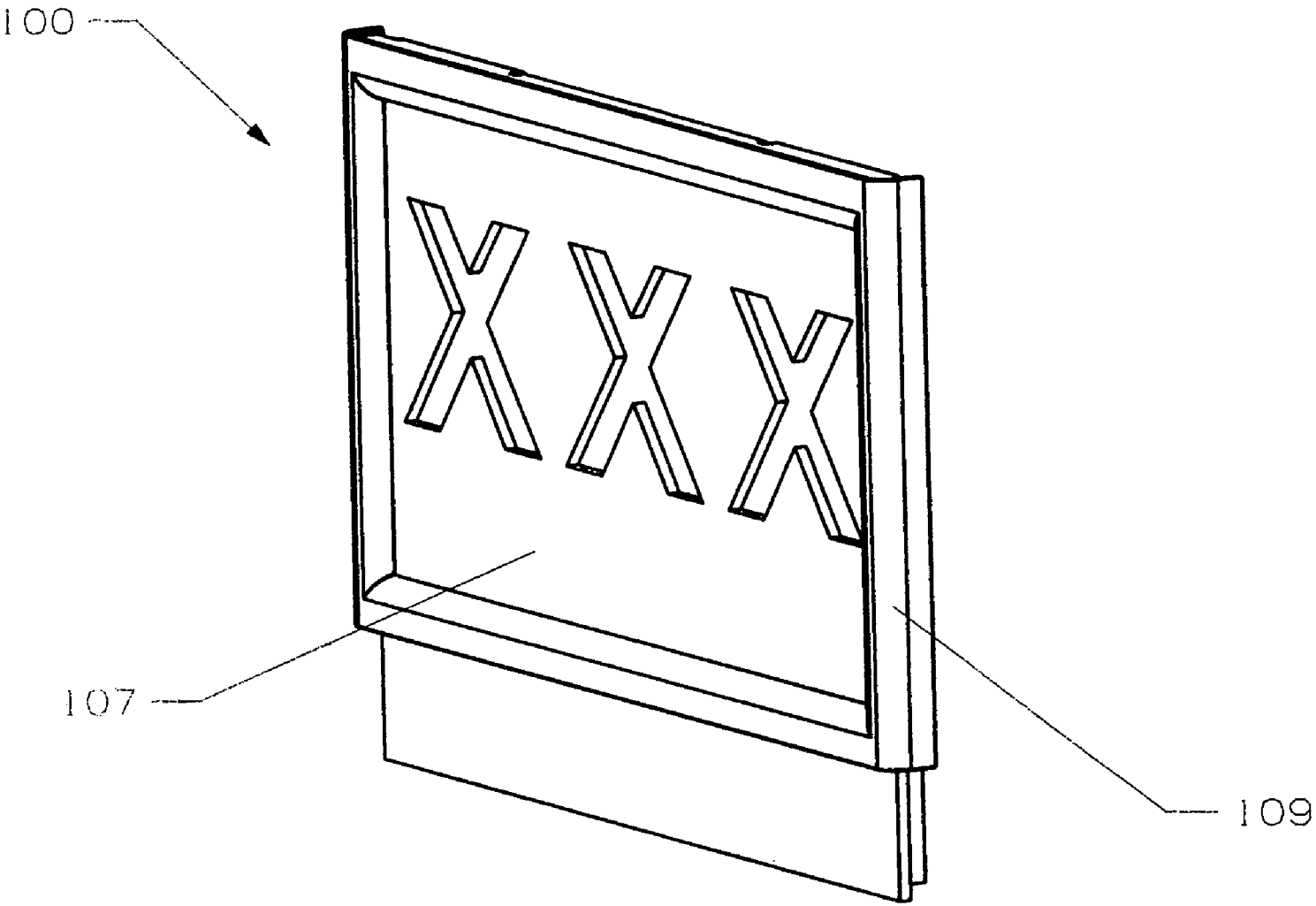
FIG. 3A provides a perspective view of an information display device according to a second embodiment.
Figure 3B:
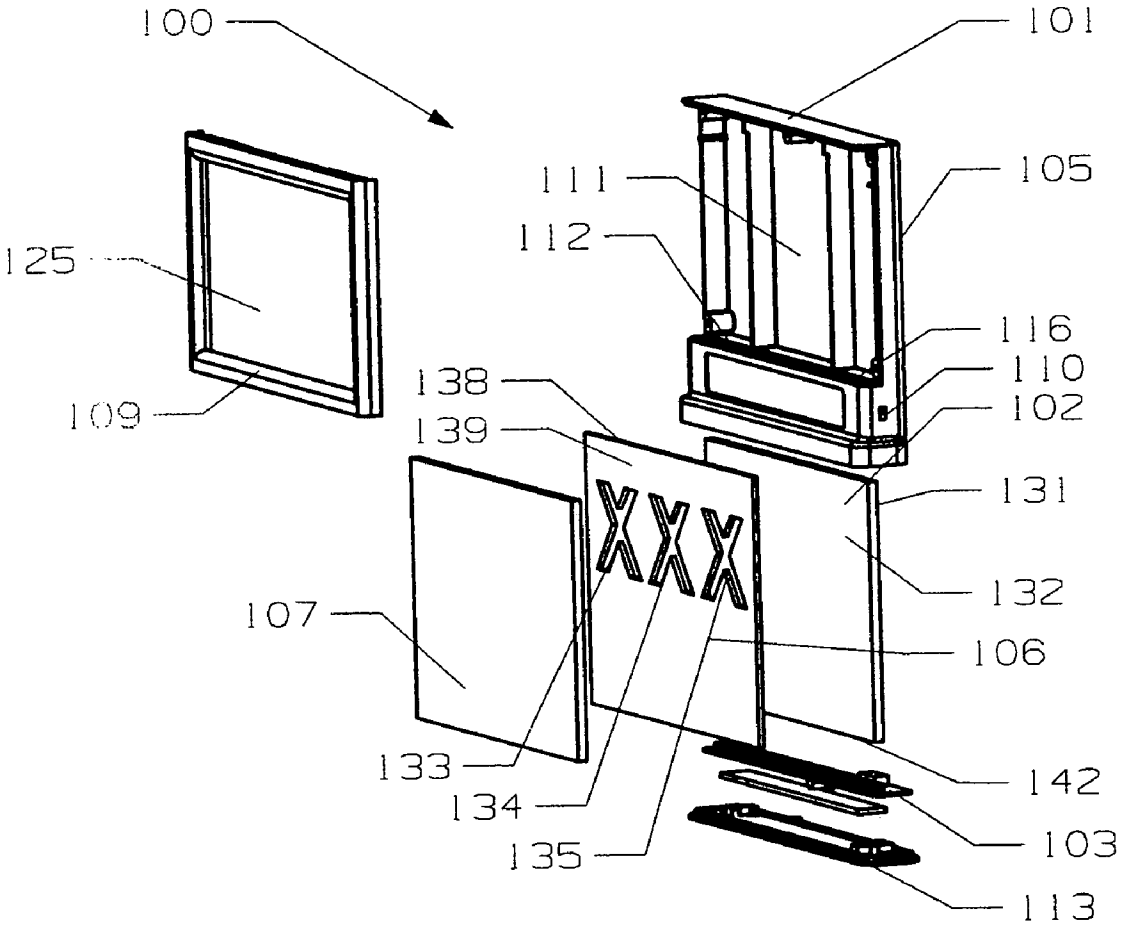
FIG. 3B provides an exploded view of the information display device according to the second embodiment.
Figure 3C:
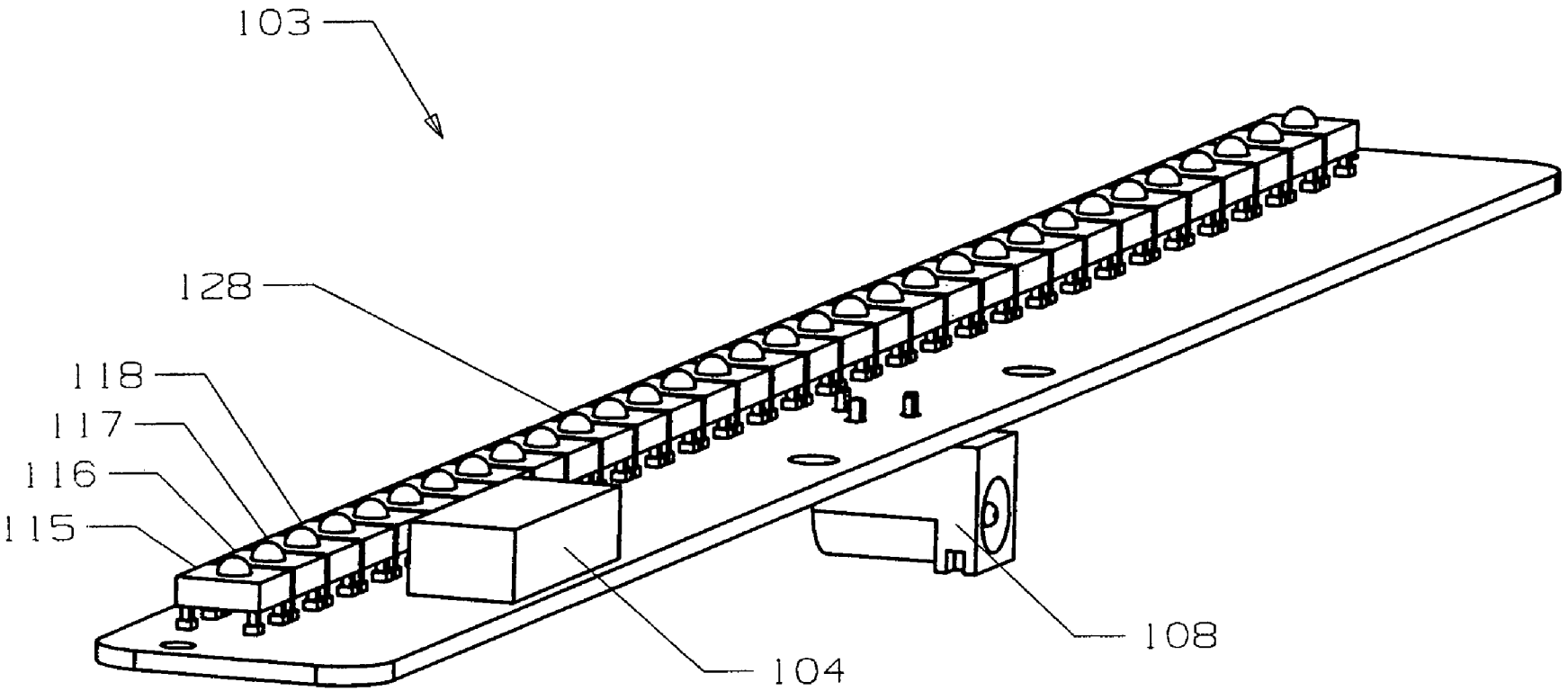
FIG. 3C provides a perspective view of a control board assembly according to the second embodiment.

In a second embodiment, an information display device 100 delivers information in a visual format. As shown in FIGS. 3A-3C, the information display device 100 includes a housing 101, a light pipe 102, an information filter 106, a cover 107, and a control board assembly 103. The housing 101 includes a body 105, a base 113, and a cap 109. The body 105 is box shaped, and includes a planar section attached to four flanges, thereby forming a chamber 111 that is open on one end. The body 105 further includes a slot 112 in a lowest flange that leads to the chamber 111. The slot 112 is suitable for accepting the light pipe 102, the information filter 106, and the control board assembly 103. The body 105 is of a shape conducive to surrounding and protecting the information display device 100 components, and may be formed from any suitable structural material, including injection molded plastics, formed metals, or the like. In this embodiment, the body 105 is formed from a resin. Illustratively, the body 105 is formed from acetal butyl styrene.

The base 113 is of a rectangular shape complementary in size to the slot 112, and mounts to the body 105 to close out the slot 112 area. The base 113 requires rigidity, as it supports the control board assembly 103, and may be constructed from virtually any structural material, including metals or plastics.

The light pipe 102 is of a rectangular shape, and is constructed from substantially any translucent material. In this embodiment, the light pipe 102 is constructed from an acrylic, and includes a lighting edge 142, a reflecting surface 131, and an emitting surface 132. The light pipe 102 has a stiffness sufficient to stand on end, and is of a size complementary to a length of the slot 112, such that the light pipe 102 may pass through the slot 112. The lighting edge 142 is an edge that is substantially perpendicular to the reflecting surface 131. The light pipe 102 may be painted on the reflecting surface 131 to reflect light passing through the light pipe 102. Illustratively, the reflecting surface 131 may be painted white. Alternatively, the reflecting surface 131 of the light pipe 102 may be etched to redirect the light transmission within the light pipe 102.

The information filter 106 is of a rectangular shape, and of a size complementary to the light pipe 102, such that the information filter 106 covers the emitting surface 132 of the light pipe 102. The information filter 106 is constructed from an opaque material, such as plastics, foils, cardboards, metals, and the like. The information filter 106 further includes at least one information port 133 passing from a first side 138 of the information filter 106 to a second side 139 of the information filter 106. The information port 133 may be of virtually any shape or form that provides a distinguishable icon or part of an icon, including letters of the alphabet, numerals, logos, and the like. The information filter 106 may further include additional information ports, wherein the multiple information ports are located at a predetermined spacing or orientation to create an object, logo, address label, words, or the like. Illustratively, the first information port 133 may be in a shape of a numeral "1," a second information port 134 may be in a shape of a numeral "2," and a third information port 135 may be in the shape of a numeral "7," thereby denoting an address of "127." Still further, the first information port 133 may be in the shape of a school logo, and may therefore project a school logo, or multiple different information ports may be combined to form the same school logo.

The cover 107 is of a rectangular shape complementary to the information filter 106, and is translucent. The cover 107 is of a thin construction, and protects the information display device 100 components from weather, handling, and projectiles. Preferably, the cover 107 is constructed from a thin polycarbonate.

The cap 109 is of a size and shape complementary to the open end of the body 105, and mounts to the body 105 using any suitable means known in the art, including fasteners, adhesives, or integral engagement features. The cap 109 includes an aperture 125 of a rectangular shape, substantially centered within the cap 109.

The control board assembly 103 includes at least a first light source 115, a second light source 116, and a controller 104. The control board assembly 103 is complementary in size to the slot 112 and the base 113, such that an upper portion of the control board assembly 103 may be inserted into the body 105 through the slot 112. The control board assembly 103 includes a light bank 128. The light bank 128 is constructed by placing a repeating pattern of light sources in a line, and may be as long as can be accommodated within the body 105. Illustratively, the light bank 128 may be a series of same color light sources, or may be a repeating order of light sources of different colors.

The first light source 115 may be any form of light source, including light emitting diodes, incandescent bulbs, fluorescent bulbs, and the like. In this embodiment, the first light source 115 is a light emitting diode of a first color, and the second light source 116 is a light emitting diode of a second color. Selection of the colors of the first light source 115 and the second light source 116 may be based on a desired light color output. Illustratively, a school having school colors of red and blue may utilize a first light source 115 that outputs a red light, and a second light source 116 that outputs a blue light. In this arrangement, the first light source 115 may be powered to deliver a red light, the second light source 116 may be powered to deliver a blue light, or the first light source 115 and the second light source 116 may be powered at varying levels to deliver a blended light. Alternatively, the information display device 100 may phase from the red light to the blue light, and from the blue light to the red light.

The controller 104 may be any form of processing device commonly utilized in electronic circuitry, and is in electrical communication with the first light source 115, the second light source 116, and a power source 108. The controller 104 regulates the power level applied to the light sources 115 and 116. The controller 104 may further include a real-time clocking mechanism for scheduling routines.

The power source 108 may be any form of remote power source, including batteries or solar cells. Alternatively, the information display device 100 may be in communication with a remote direct current or converted alternating current source. In this embodiment, the power source 108 is a remote converted alternating current source that supplies power to the information display device 100 through a power cord.

On assembly, the information filter 106 is disposed directly in front of the emitting surface 132 of the light pipe 102, and the cover 107 is disposed directly in front of the information filter 106. The light pipe 102, the information filter 106, and the cover 107 are inserted into the slot 112, and may be guided into position using guide rails, or other suitable means to secure the components into a working position. The control board assembly 103 may then be secured to the base 113 using any suitable means, including screws, snaps, or the like. The control board assembly 103 is then be inserted into the slot 112, and the base 113 is secured to the body 105, thereby securing the control board assembly 103 into position. Upon securing of the base 113 to the body 105, the light bank 128 is disposed directly beneath the lighting edge 142 of the light pipe 102. In this first embodiment, the light bank 128 is as long as the length of the lighting edge 142. The cap 109 may then be secured to the body 105, thereby closing out the information display device 100.

In use, when the light sources 115 and 116 in the light bank 128 are powered, the emitted light passes through lighting edge 142 and illuminates the light pipe 102 with direct and refracted light. The refracted light in the light pipe 102 reflects off of the reflecting surface 131, and further illuminates the light pipe 102. The illuminated light pipe 102 is then visible from a front of the information display device 100 through the information ports 133, 134, and 135 of the information filter 106. As the information filter 106 prohibits light from passing through the opaque portions of the information filter 106, the illuminated light pipe 102 is then visible through the information filter 106 in the form or shape of the information ports 133, 134, and 135. Viewers must look within the aperture 125 of the cap 109, and through the transparent cover 107 to see the information ports 133, 134 and 135.

In this second embodiment, the information display device 100 executes a phasing sequence in similar fashion to the first embodiment, wherein the controller 104 applies progressive levels of pulse width modulation to the first light source 115 and the second light source 116 to gradually transition from illuminating the information display device 100 in the first color, blending from a predominantly first color to an evenly blended color, to a blended predominantly second color, and to illuminating the information display device 100 in the second color, and possibly reversing the process. As shown in FIGS. 2A through 2E, the sequencing trend for transitioning between two colors may start with a first light source 115 that emits a blue light, and a second light source 116 that emits a red light. FIG. 2A illustrates a first trend point wherein the first light source 115 is powered at one hundred percent, and the second light source 116 is not powered, thereby delivering a blue light to the information display device 100. The second trend point shown in FIG. 2B illustrates the first light source 115 powered at eighty percent and the second light source 116 powered at twenty percent, thereby delivering a mixed light. The third trend point is shown in FIG. 2C, and shows first light source 115 and the second light source 116 powered equally at fifty percent, thereby delivering a (red/blue) light to the light pipe 102. The trend continues with the powering scheme disclose in FIG. 2D, wherein the second light source 116 is powered at eighty percent and the first light source 115 is powered at twenty percent, thereby displaying a predominantly red color.

In the next trend point, FIG. 2E, the second light source 116 is powered at one hundred percent, thereby illuminating the information display device 100 in a red color. The process continues with the return to the state described in FIG. 2D, wherein the power to the second light source 116 is decreased to eighty percent, and the power to the first light source 115 is increased to twenty percent. The controller continues to the state previously described in FIG. 2C, wherein the first light source 115 and the second light source 116 are powered equally, thereby displaying a mixture of red and blue light. The trend continues by decreasing the power level of the second light source 116 to twenty percent, and increasing the power level of the first light source 115 to eighty percent, as shown in FIG. 2B. The controller then moves to the state associated with FIG. 2A, wherein a blue light is delivered to the information display device 100, and recommences the sequence.

While this example has been shown with concrete data points, one of ordinary skill in the art will recognize that the data points merely are exemplary of a trend, and that the power variable may be broken down into virtually any number of power level segments. Illustratively, a power level broken into one hundred segments may be applied with any number of segments between zero and one hundred. Alternatively, the power level may be divided into a greater number of segments to produce a gradual transition. One of ordinary skill in the art will further recognize that a timing function is also required, wherein the time increment or duration may be lengthened to deliver a gradual transition or shortened to deliver a faster transition.

It should be clear to one of ordinary skill in the art that this example is only one of many derivatives that may create a phasing sequence that may produce similar effects. It should also be clear to one of ordinary skill in the art that this example is not limiting in scope, as the colors may change, the power values may be altered, and the timing sequence may be altered to produce a similar effect.

While this embodiment has been shown with a first light source 115 and a second light source 116, one of ordinary skill in the art will recognize that larger quantities of light sources may be utilized to broaden the range of colors available. Illustratively, a third light source 117 having a third color may be utilized to add an additional color spectrum, or to create a color not available as a light source. In this case, the light bank 142 repeats a pattern of the three light sources to provide an even lighting across the light pipe 102.

One of ordinary skill in the art will further recognize that phasing through a full color spectrum may be achieved if light sources of the three primary colors are represented on the control board assembly 103. Illustratively, a light source emitting a red light, a light source emitting a blue light, and light source emitting a green light would be required on the control board assembly 103. All possible colors of the color pallet are assigned a digital number, and the controller 104 then scrolls through the digital numbers, thereby phasing through the entire color spectrum. One of ordinary skill in the art will still further recognize that the controller 104 may be able to scroll through a desired partial spectrum, or even a single color with varying intensity.

Illustratively, a three light source phasing scheme containing the three primary colors commences with the previously disclosed state charts shown in FIGS. 2A through 2E, and further encompasses FIGS. 2F through 2M. After the controller 104 executes the steps shown and described in FIGS. 2A through 2E, the controller 104 adjusts the power levels to those shown in FIG. 2F, wherein the power level of the second light source 116 is decreased to eighty percent, and a power level for the third light source 117 is increased to twenty percent, thereby delivering a blended light to the light pipe 102. The controller 104 continues the trend by moving to a state described in FIG. 2G, wherein the second light source 116 and the third light source 117 are powered equally, thereby delivering a blended light to the light pipe 102. The next trend point is shown in FIG. 2H, wherein power to the second light source 116 is decreased to twenty percent, and the power to the third light source 117 is increased to eighty percent. The controller 104 then moves to conditions shown in FIG. 2I, wherein power to the second light source 116 is ceased, and the power to the third light source 117 is elevated to one hundred percent, thereby illuminating the light pipe 102 in a green color.

The controller 104 then moves to a state described in FIG. 2J, wherein all three of the light sources 115 through 117 are at least partially powered. In this example, the state described in FIG. 2J provides for full power to the third light source 117, and twenty percent power to the first light source 115 and the second light source 116, thereby delivering a blended light to the light pipe 102. The controller 104 continues the trend by increasing the power levels of the first light source 115 and the second light source 116, as shown in FIG. 2K, and then FIG. 2L. The trend continues with the controller 104 increasing the power levels of the first and second light sources 115 and 116 to full power, as described in FIG. 2M, thereby delivering a blended light to the light pipe 102.

One of ordinary skill in the art will readily recognize that this example may be continued, recommenced, or phased to either of the other light sources 115 through 117. One of ordinary skill in the art will further recognize that this example is merely a small sample of the range of colors and color mixes possible in this invention, and that the number of light sources may be increased to or decreased dependent upon applications.

The information display device 100 may further include a booster light source 118 to increase the intensity of the information display device 100. The booster light source 118 emits a white light that complements the other light sources, and may be disposed on the control board assembly 103 as part of the repeating pattern of light source colors. Illustratively, the previously disclosed light pattern of a red, blue, red, blue, . . . , would then be: red, blue, white, red, blue, white, . . . etc.

In use, the information display device 100 continuously illuminates the light pipe 102 in varying shades of pre-selected colors, thereby displaying the illuminated light pipe 102 in the shape of all information ports 133 disposed within the information filter 106. The information display device 100 may be used as a decoration, an informative device, or even a novelty item. In an extension of the second embodiment, an information display device 100 may be placed on a front of a structure or location requiring identification. Illustratively, the information display device 100 may be used to provide an address, a resident's name, or other information requiring to be conveyed to visitors, or workers, such as truck drivers.

While this second embodiment has been shown with an information filter 86, one of ordinary skill in the art will recognize that a dynamic information filter 83 or a hybrid information filter 84 may be utilized in place of the information filter 86, as described in the first embodiment.

Figure 4A:
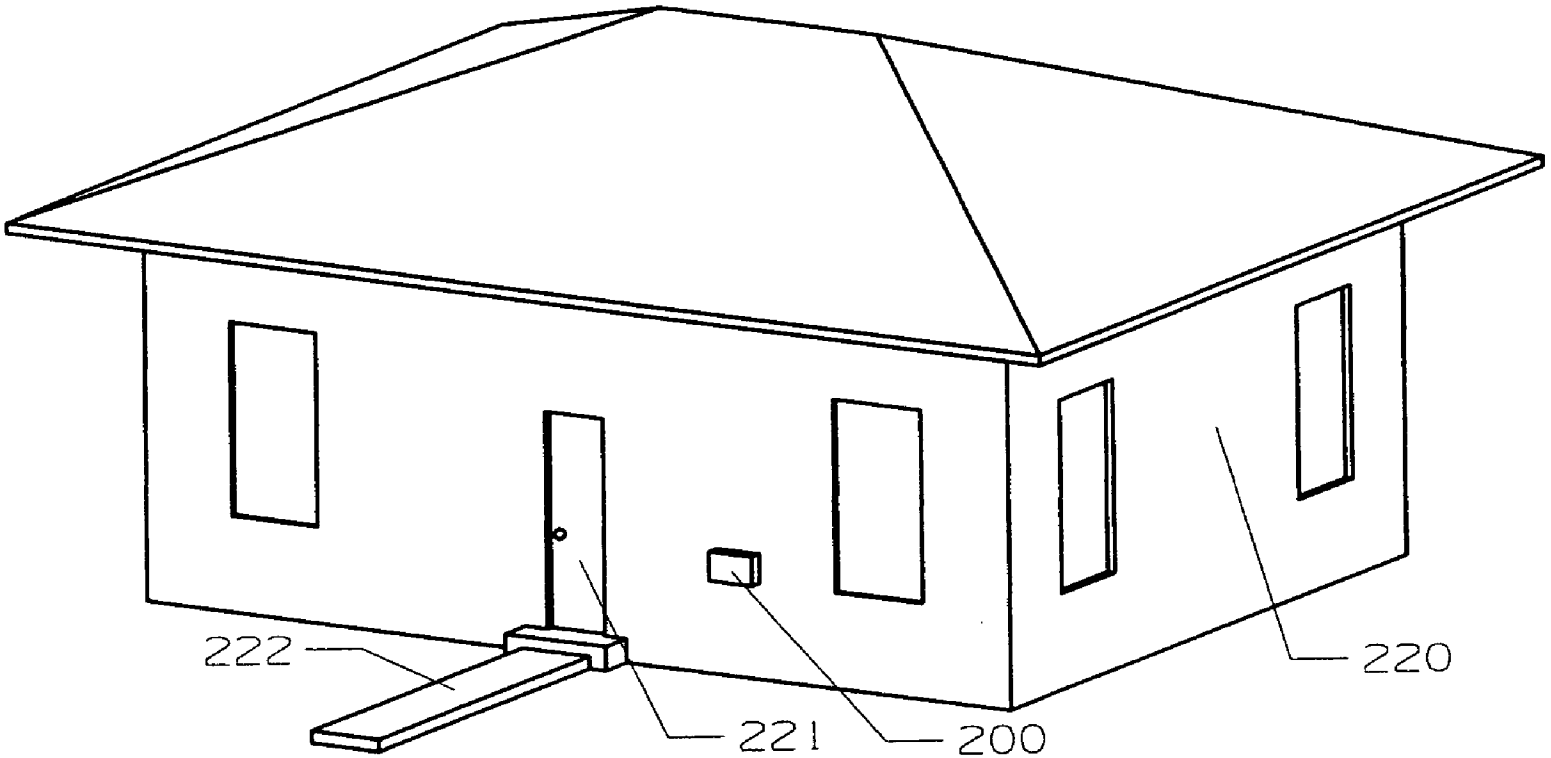
FIG. 4A provides a perspective view of a structure including an information display device according to a third embodiment.

In a third embodiment, an information display device 200 is substantially identical in function to the information display device 100, however, the information display device 200 is designed to fit directly into a wall of a structure or building, and is utilized to convey information to persons near the structure. As shown in FIG. 4A, the information display device 200 is mounted to a structure 220 having an approach strip 222 leading up to an entry panel 221. In this third embodiment, the information display device 200 is similar in function to the information display device 100, but is permanently secured to the structure 220.

Figure 4B:
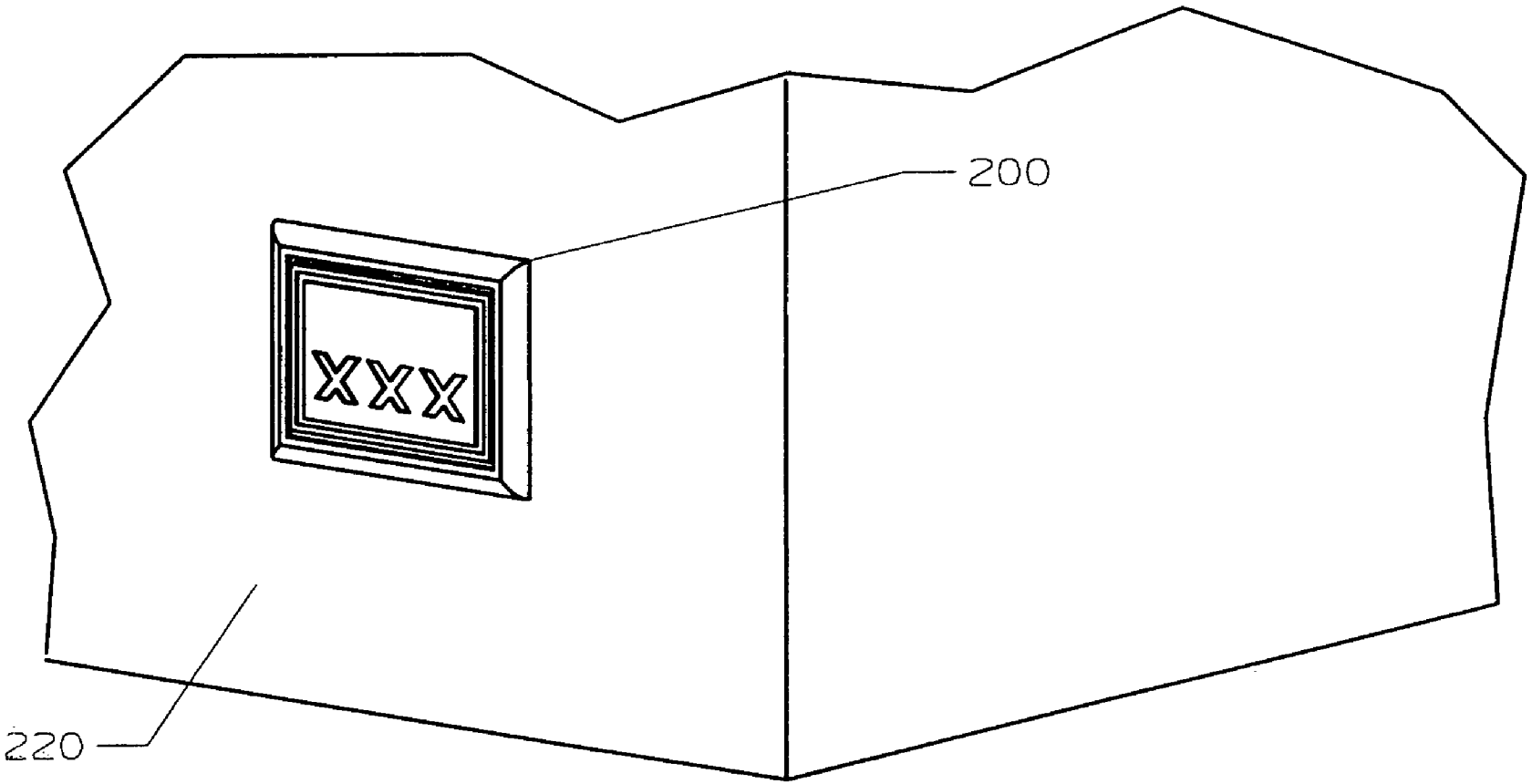
FIG. 4B provides a perspective view of an information display device disposed within a wall of the structure according to the third embodiment.
Figure 4C:
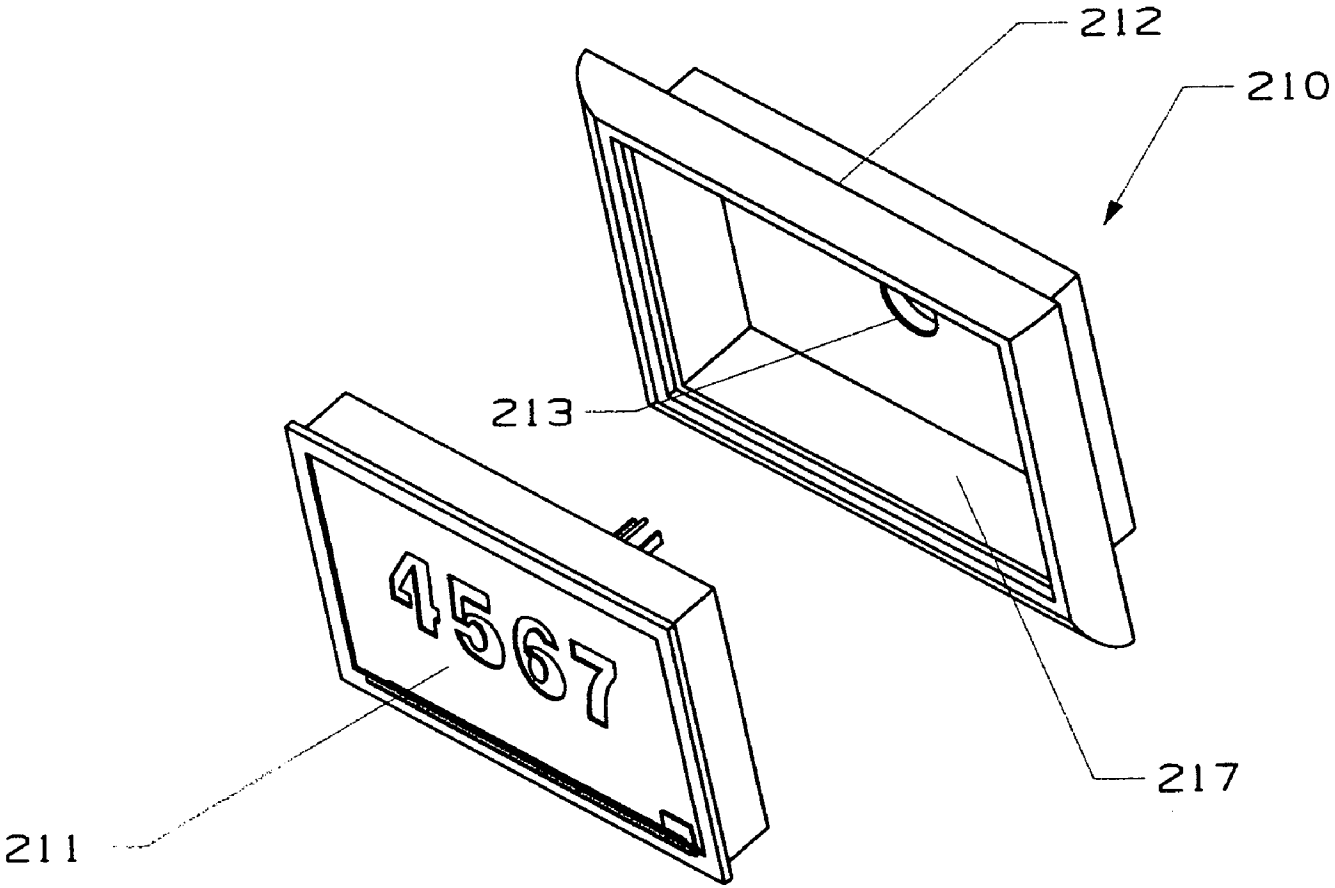
FIG. 4C provides an exploded view of the information display device according to the third embodiment.

As shown in FIGS. 4B-4C, the information display device 200 mounts substantially flush to an outer wall of the structure 220. The information display device 200 may be installed during construction of the structure 220; may be retrofit into the structure 220; or may be disposed adjacent to or in proximity to the structure 220. In cases where the information display device 200 is installed into a masonry exterior, the information display device 200 may be available in sizes of standard concrete masonry products, such as bricks, cinder blocks, cut stone, and the like. In cases where the information display device 200 is installed in a wood frame structure, a frame and support scheme may be required. The information display device 200 is designed to operate on power available at the structure 220. Illustratively, the information display device 200 operates on a one hundred twenty volts alternating current, as commonly available in a residential structure. One of ordinary skill in the art will recognize that other voltages or forms of power may be utilized with proper conversion components.

As shown in FIG. 4C, the information display device 200 includes a receiving assembly 210 and an information display module 211. The receiving assembly 210 is permanently secured to the structure 220, and includes a receiving frame 212 having a receiving chamber 217. The receiving frame 212 includes a rear wall 234, and supports 235 that extend perpendicularly from the rear wall 234 to form the receiving chamber 217. The receiving frame 212 further includes a flange 236 that extends perpendicularly outward from the supports 235. The receiving frame 212 may be constructed from virtually any material that presents an aesthetically pleasing presence, including metals, plastics, plated materials, and the like. One of ordinary skill in the art will recognize that metals may include brasses, bronzes, stainless steels, aluminums, coppers, tins, and other metals that are conducive to forming and polishing. The rear wall 234 further includes an aperture 237 that accepts a prong socket 213. The prong socket 213 is connectable to a power supply of the structure 220. Illustratively, the prong socket 213 is coupled to a one hundred twenty volt alternating power source. The prong socket 213 may be any form of commercially available electrical power socket that is rated for the supplied voltage load.

Figure 4D:
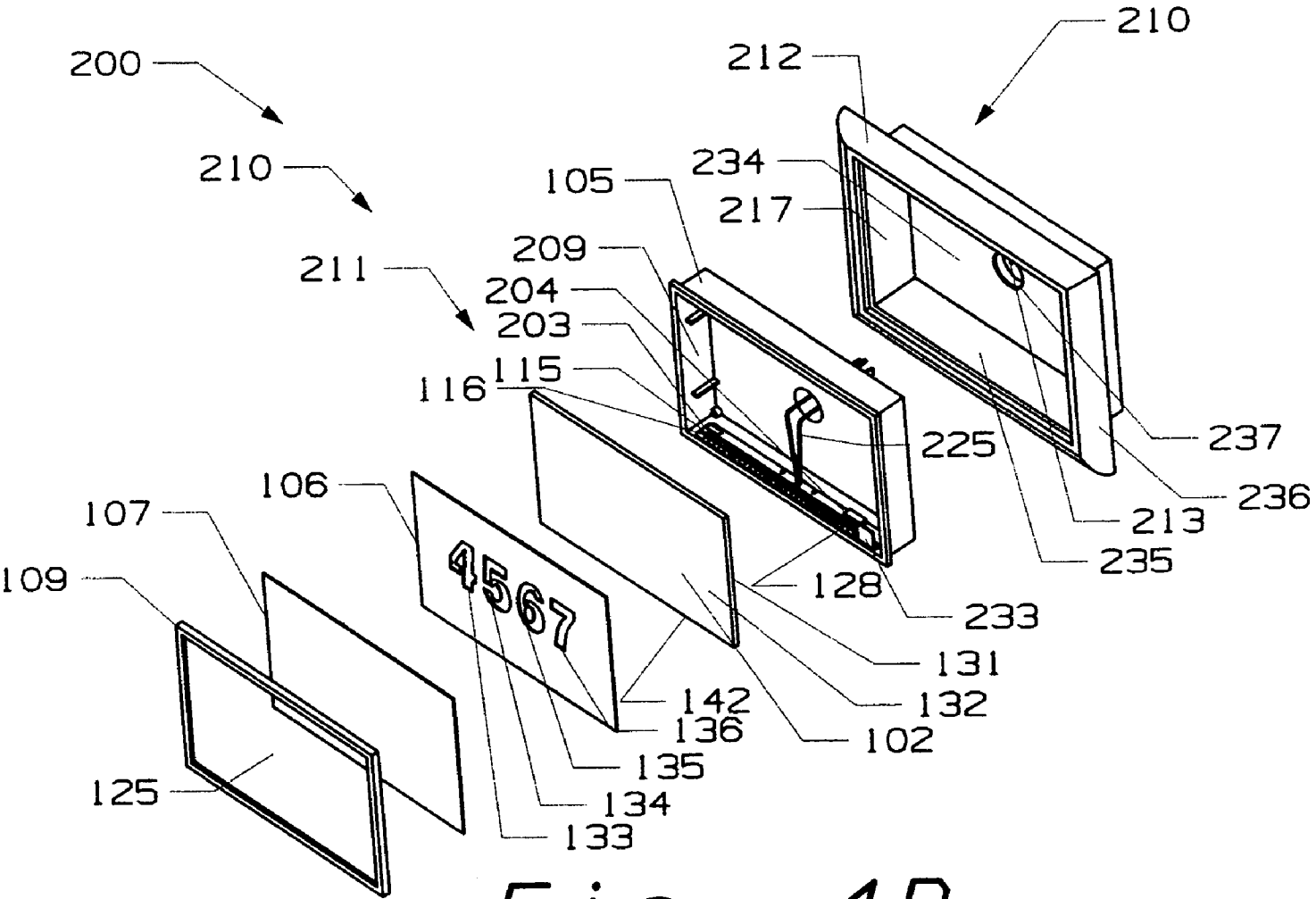
FIG. 4D provides an exploded view of the information display device according to the third embodiment.

The information display module 211 is an integral unit that fits into the receiving chamber 217 of the receiving assembly 210. The information display module 211 is substantially identical to the information display device 100 of the first embodiment; however, the information display module 211 further includes plug-in electrical components that connect the information display module 211 to a permanent electrical power source. As shown in FIG. 4D, the information display module 211 includes a body 105 having a chamber 209, and an aperture in a rear portion to accept a plug prong 231. The size of the body 105 is complementary to the size of the receiving chamber 217 in the receiving frame 212. The body 105 is closed out with a cap 109 that is complementary in size to the body 105. The cap 109 is substantially identical in form and function to the cap 109 of the first embodiment, and includes an aperture 125. In this third embodiment, the cap 109 may be constructed from materials providing an enhanced stature, including polished metals, plated metals plated plastics, and the like.

The information display module 211 further includes the light pipe 102, the information filter 106 having at least one information port 133, and the cover 107. All three of these components are identical in form and function to those referenced in the second embodiment, wherein the light pipe 102 includes a reflecting surface 131, an emitting surface 132, and a lighting edge 142. The information filter 106 is placed onto the emitting surface 132 of the light pipe 102, and the cover 107 is then placed onto a viewing side of the information filter 106. The assembly is then inserted into the chamber 209 of the body 105.

The information display module 211 further includes a control board assembly 203 that is similar in form and function to the control board assembly 103 of the previous embodiments, but further includes an input device 233. The control board assembly 203 includes a first light source 115, a second light source 116, a controller 204, and a power harness 225. The light sources 115, 116, and 118 are arranged in a light bank 128, as in the second embodiment, that extends the length of the light pipe 102. The control board assembly 203 is mounted to the body 105. The input device 233 may be any form of input mechanism commonly utilized in the electronics industry, including push buttons, toggle switches, and the like. In this third embodiment, the input device 233 is a touch sensor device, wherein a user is able to place a digit adjacent to the touch sensor to deliver an input.

The power pigtail harness 225 connects the control board assembly 203 to the plug prong 231 and a permanent electrical power source. A permanent connection in this embodiment includes items that may remain connected indefinitely without hazard. One of ordinary skill in the art will recognize that permanent electrical connections may be disengaged either by cutting a wire, removing wire nuts, and the like. While this embodiment has been shown with hardwire connections, one of ordinary skill in the art will recognize that free-hanging connectors may be utilized in lieu of the prong socket 213 in conjunction with the plug prong 231.

In operation, the information display module 211 defaults to a phase routine and executes the phase routine until an input is received at the input device 233. Upon the recognition of an input signal, the controller 204 locks onto the particular digital identifier of the color being displayed at the instant the input signal is received, and holds the particular color. The controller 204 holds the particular color until an additional input signal is received at the input device 233.

Figure 4E:
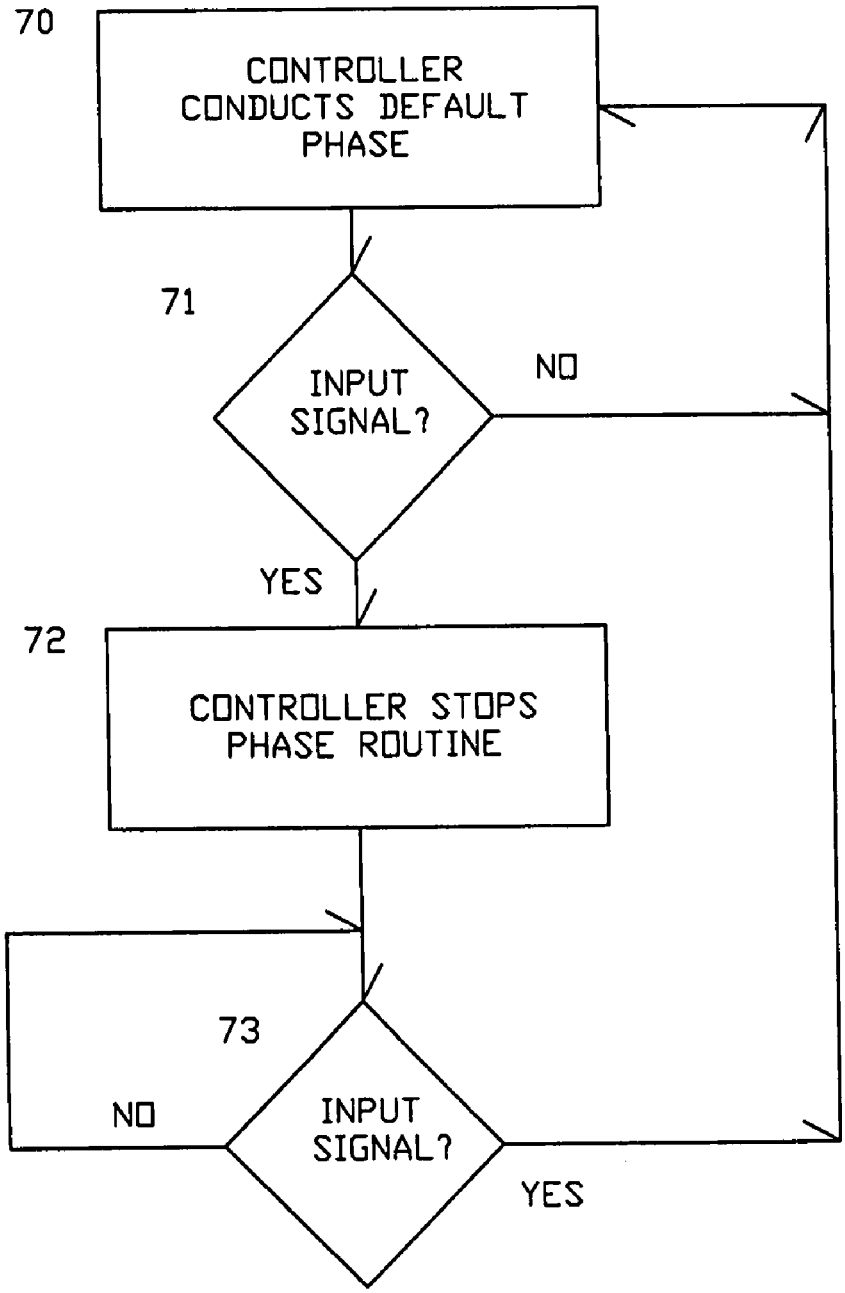
FIG. 4E provides a flowchart illustrating the method steps for utilizing the information display device according to the third embodiment.

FIG. 4E provides a flowchart illustrating the method steps for utilizing the information display device 200. As shown in step 70, the controller 204 defaults to a phase sequence upon powering. The controller 204 then moves to step 71, wherein the controller 204 determines if an input signal has been received at the input device 233. If the controller 204 determines that an input signal has not been received in step 71, the controller 204 returns to step 70 to continue the phase routine.

If the controller 204 determines that an input signal was received in step 71, the controller 204 moves to step 72, wherein it stops the phase routine on the color being displayed when the input signal was received, thereby illuminating the light pipe 102 in a constant color light. The controller 204 then moves to step 73, wherein the controller 204 determines if an input signal has been received. If the controller 204 determines that an input signal has not been received in step 73, the controller 204 returns to step 72 to continue the with the display of a constant color light. If the controller 204 determines that an input signal has been received in step 73, the controller 204 returns to step 70 to recommence the phase routine.

In use, the receiving assembly 210 of the information display device 200 is permanently mounted into a wall of the structure 220. The receiving assembly 210 may be built into the structure 220 or may be retrofit into the structure 220. The receiving assembly 210 is further permanently connected to a power supply available at the structure 220. Once installed, the flange 236 may protrude slightly from the outer surface of the structure 220. Upon assembly, the information display module 211 is inserted into the receiving chamber 217, and the plug prongs 231 are inserted into the prong socket 213. Upon full insertion, electrical power is supplied to the information display module 211, and the controller 204 executes the phase routine as described in the first embodiment, thereby delivering crisp illuminated areas in the shape of the information ports 133 through 135. One of ordinary skill in the art will recognize that the number of information ports utilized may fluctuate depending on the number of alphanumeric characters in an address, or name.

While this third embodiment has been shown with an information filter 106, one of ordinary skill in the art will recognize that a dynamic information filter 83 or a hybrid information filter 84 may be utilized in place of the information filter 106, as described in the first embodiment.

Figure 5A:
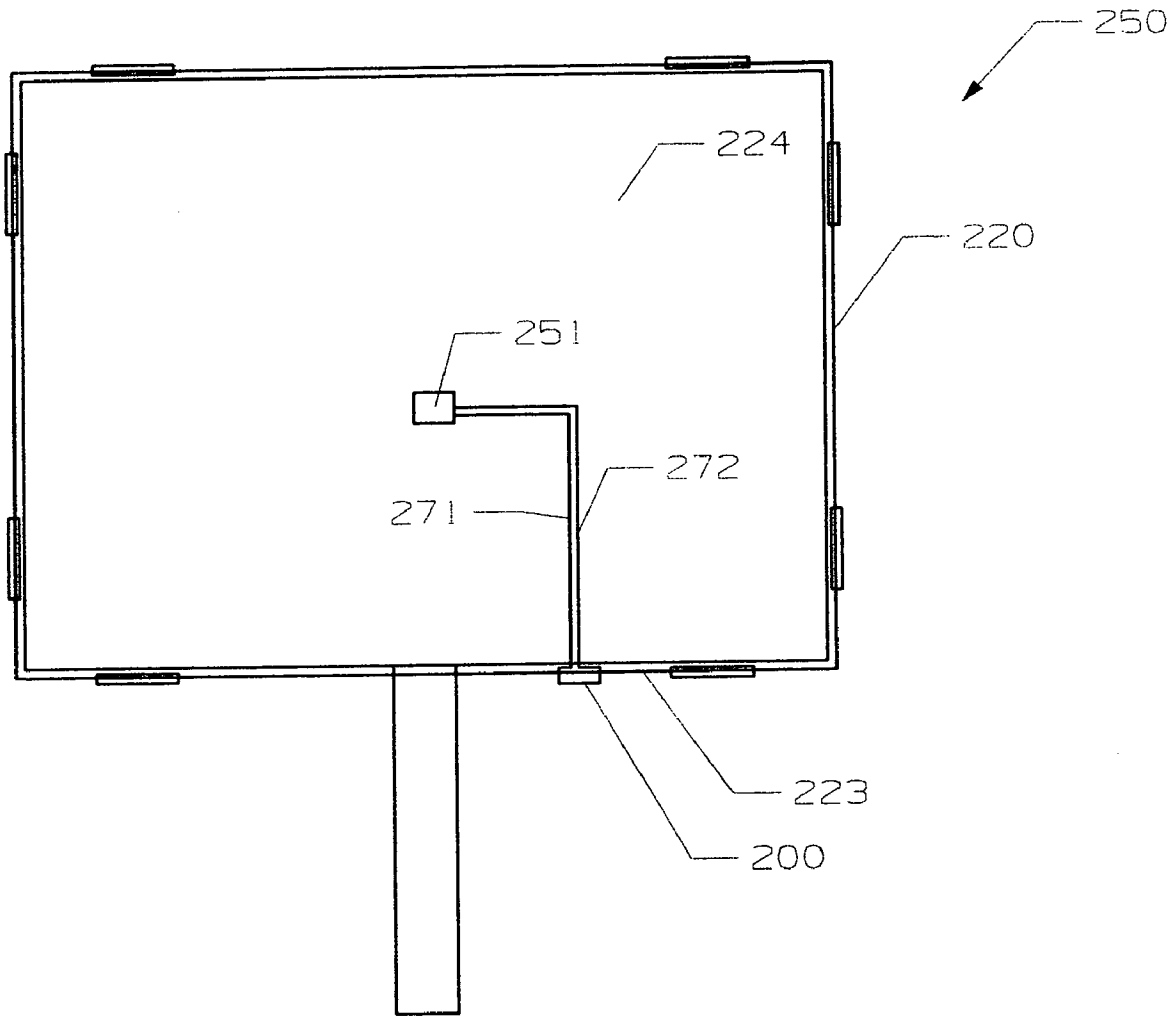
FIG. 5A provides a cross section view of a structure utilizing an information display device according to a fourth embodiment.
Figure 5B:
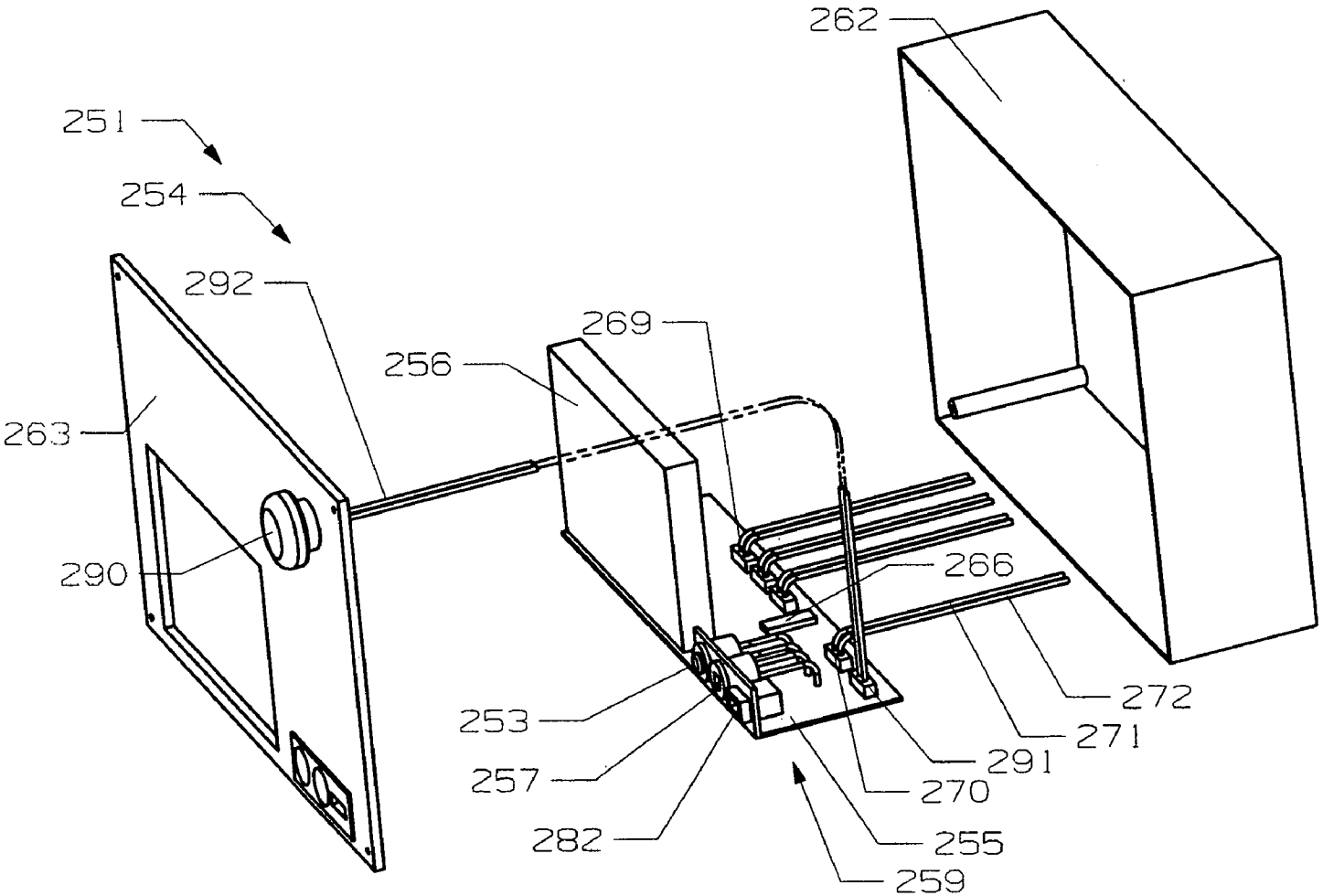
FIG. 5B provides an exploded view of a control module according to the fourth embodiment.

In a fourth embodiment, an illumination system 250 includes the information display device 200 as described in the third embodiment in communication with a control module 251. As shown in the cross-section of the structure 220 in FIG. 5*a*, the information display device 200 is suitably mounted and restrained in an outer wall 223 of the structure 220, and the control module 251 is suitably mounted in an interior portion 224 of the structure 220, such that residents may interact with the control module 251.

The control module 251 includes a housing 254, a control board assembly 259, and a communication harness 277. The housing 254 includes a shell 262, and a faceplate 263. The shell 262 is rectangularly shaped, and includes a cavity for housing control components. The faceplate 263 is substantially planar, and is of a size complementary to the shell 262, such that the faceplate 263 closes out the shell 262. The faceplate 263 includes apertures to provide access to interface components or for mounting interface components. The shell 262 may further include apertures to allow harnesses and power cables into the interior of the shell 262.

The control board assembly 259 includes a control board 255, a controller 266, a first input 253, a second input 257, and an output 256. The control board 255 may be any form of electronic circuitry panel that enables electrical components to interact with each other, including printed circuit boards. The controller 266 is disposed on the control board 255, and may be any form of embedded controller utilized in the electronics industry, including, four bit processors, eight bit processors, sixteen bit processors, and the like. The first input 253 is disposed on the control board 255, and is in electrical communication with the controller 266. The first input 253 may be any form of device capable of delivering a signal to the controller 266, including a button, switch, touch sensor panel, and the like. The second input 257 is in electrical communication with the controller 266, and may be any form of input device, including input plugs for receiving harnesses, telephone lines, data lines, and the like. The output 256 is also disposed on the control board 255, and is in communication with the controller 266. The output 256 may be any form of signal outputting device capable of delivering commands or prompts to an operator. Illustratively, in this fourth embodiment, the first input 253 is a pushbutton, the second input 257 is a RS232 socket for receiving a telephone line, and the output 256 is a liquid crystal display panel.

The control board 255 further includes a power input jack 269, a signal output jack 270, and a warning jack 291. In this fourth embodiment, power is supplied to the power input jack 269 from the power source available at the structure 220. A first leg 271 and a second leg 272 of the communication harness 277 are coupled to the signal output jack 270, and are further connected to the prong socket 213 of the information display device 200.

The illumination system 250 may further include an alarm actuator 290 that is in communication with the control board assembly 259 through a warning harness 292. In this case, the alarm actuator 290 is any form of actuation device that may receive a signal from a user, including push buttons, switches, and the like. Illustratively, in this fourth embodiment, the alarm actuator 290 is a pushbutton in electrical communication with the warning jack 291 of the control board assembly 259. The alarm actuator 290 may be located within the control module 251, or may also be remotely located in a central, accessible location within the structure 220, such that users may easily actuate the alarm actuator 290 in an emergency.

The control module 251 may further include an external communication port 282 disposed on the control board assembly 259 to provide for electrical communication between the control module 251 and an external device, such as a palm pilot, computer, ipod, or other processing devices, to modify, alter variables, or upgrade the capability of a software program, thereby providing a user with the ability to personally tailor the illumination system 250. Illustratively, in this fourth embodiment, the external communication port 282 is a universal serial bus port disposed on the control board assembly 259.

On assembly, the control board assembly 259 is housed within the cavity of the shell 262, such that the control board assembly 259 is protected by the shell 262, and the input and output components face the open portion of the shell. The faceplate 263 is then secured to the open portion of the shell 262, such that the apertures align with the output 256, and the control components. The communication harness 277 and the power cables may enter through apertures located in the rear or lower portion of the shell 262. One of ordinary skill in the art will recognize that the control module 251 may then be secured to any wall in the interior portion 224 of the structure 220.

The setup continues with the coupling of the alarm actuator 290 and the information display device 200, to the control module 251. The alarm actuator 290 is connected to the harness 292, and the harness 292 connects to the warning jack 291 disposed on the control board assembly 259. The first and second electrical transmission lines 271 and 272 are then connected to the signal output jack 270 on the control board assembly 259, and the plug prongs 231 of the information display device 200, such that the control module 251 may deliver control signals and power to the information display device 200 through the first and second electrical transmission lines 271 and 272. In this embodiment, the electrical signals are transmitted along the first and second electrical transmission lines 271 and 272 utilizing a pulse width modulation.

In this fourth embodiment, the illumination system 250 is capable of phasing as disclosed in the previous embodiments, phasing at a fast pace to allow an operator to quickly cycle through the phase sequence, locking on a specific color, and a flashing routine. A fast phasing mode is substantially identical to the phase mode of the first embodiment, however, the time interval between steps of the fast phase is significantly reduced compared to the default phase routine, thereby allowing a user to view the color spectrum in a short period. Illustratively, the time interval for the fast phase in this embodiment is approximately half of the time interval of the default phase. The locking on a specific color allows a user to pick a color from the fast phase sequence, and hold the illumination system 250 on the selected color. In this case, the illumination system 250 provides the capability for personal preferences. The flashing routine is an emergency routine initiated by a user, and forces the controller 266 to flash the information display device 200 in a red color, thereby warning individuals outside of the residence that help is required, or as a locating aid for emergency responders attempting to locate the residence after a call to emergency services.

While this embodiment has been shown with four distinct routines, one of ordinary skill in the art will recognize that many deviations of flashing, phasing, and locking on a specific color may be possible with the external communication port 282 as described herein. One of ordinary skill in the art will further recognize that other routines may be added at a later time, or other variables may be adjusted to deliver a unique upgraded routine set.

Upon powering, the illumination system 250 defaults to the default phasing routine, as discussed in the second embodiment, and remains in the default phase routine until an input is received from a user. In this embodiment, the illumination system 250 goes into the fast phase mode when the first input 253 is depressed. The illumination system 250 remains in the fast phase mode until the first input 253 is depressed a second time, at which point the controller 266 places the digital identification number of the color displayed at the time the input 253 is depressed into memory. The controller 266 powers the light sources to deliver the displayed color, and remains on that particular power setting to continuously deliver the selected color scheme. The illumination system 250 continues to display the selected color until the first input 253 is actuated once more, thereby sending the illumination device 250 into the phase mode.

Figure 5C:
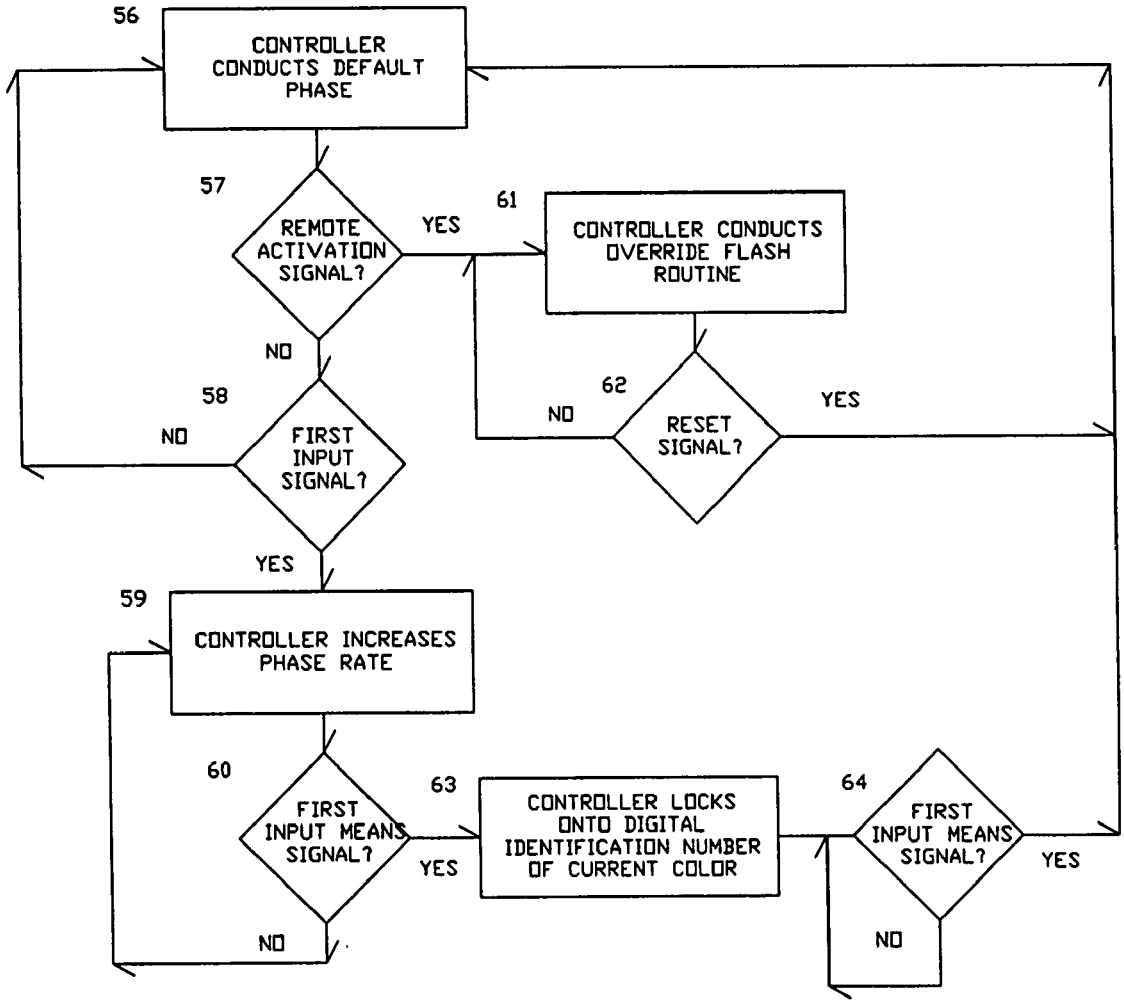
FIG. 5C provides a flow chart illustrating the method steps for operating the illumination system according to the fourth embodiment.

FIG. 5C provides a flowchart illustrating the method steps for utilizing the illumination system 250 according to this fourth embodiment. As shown in step 56, upon powering, the controller 266 executes a default phase routine. The controller 266 moves to step 57, wherein it determines if an alarm signal has been received. If an alarm signal has been received in step 57, the controller 266 moves to step 61 to override the phase routine, and execute a flash routine. The controller 266 then moves to step 62, wherein the controller 266 determines if the first input 253 has been actuated. If the first input 253 has been actuated in step 62, the controller 266 returns to step 56 to recommence the default phase routine. If the first input 253 has not been actuated in step 62, the controller 266 returns to step 61, and continues to execute the flash routine.

If the alarm signal has not been received in step 57, the controller 266 moves to step 58, wherein the controller 266 determines if the first input 253 signal has been received. If the first input 253 signal has not been received in step 58, the controller 266 returns to step 56 and continues to execute the default phase routine. If the first input 253 signal has been received in step 58, the controller 266 moves step 59, wherein the controller 266 increases the rate of the default phase routine, thereby moving into a fast phase routine. The controller 266 then moves to step 60, wherein the controller 266 determines if the first input 253 signal has been received. If the first input 253 signal has not been received in step 60, the controller returns to step 59, and continues to execute the fast phase routine.

If the first input 253 signal has been received in step 60, the controller 266 moves to step 63, wherein the controller 266 places the digital identifier of the displayed color when the first input 253 signal was received into memory, and locks onto the power levels associated with the digital identifier of the color displayed at the time of the signal input, thereby delivering a constant light stream of the selected color. The controller 266 then moves to step 64 to determine if a first input 253 signal has been received. If a first input 253 signal has not been received in step 64, the controller 266 returns to step 63, and continues to execute the single digital identifier associated with the selected color scheme. If a first input 253 signal has been received in step 64, the controller 266 returns to step 56, to and commences to execute the default phase routine.

In operation, power is delivered to the control board assembly 259, and the controller 266 regulates the delivery of power and signals to the information display device 200. In this fourth embodiment, the controller 266 utilizes an alternating current signal on the communication harness 277. In this embodiment, the controller 266 pulse width modulates the signals on the alternating current, and accordingly, only two wires are required to fully activate the information display device 200. As previously disclosed, the first input 253 may be actuated to direct the illumination system 250 to move to a next mode.

Figure 5D:
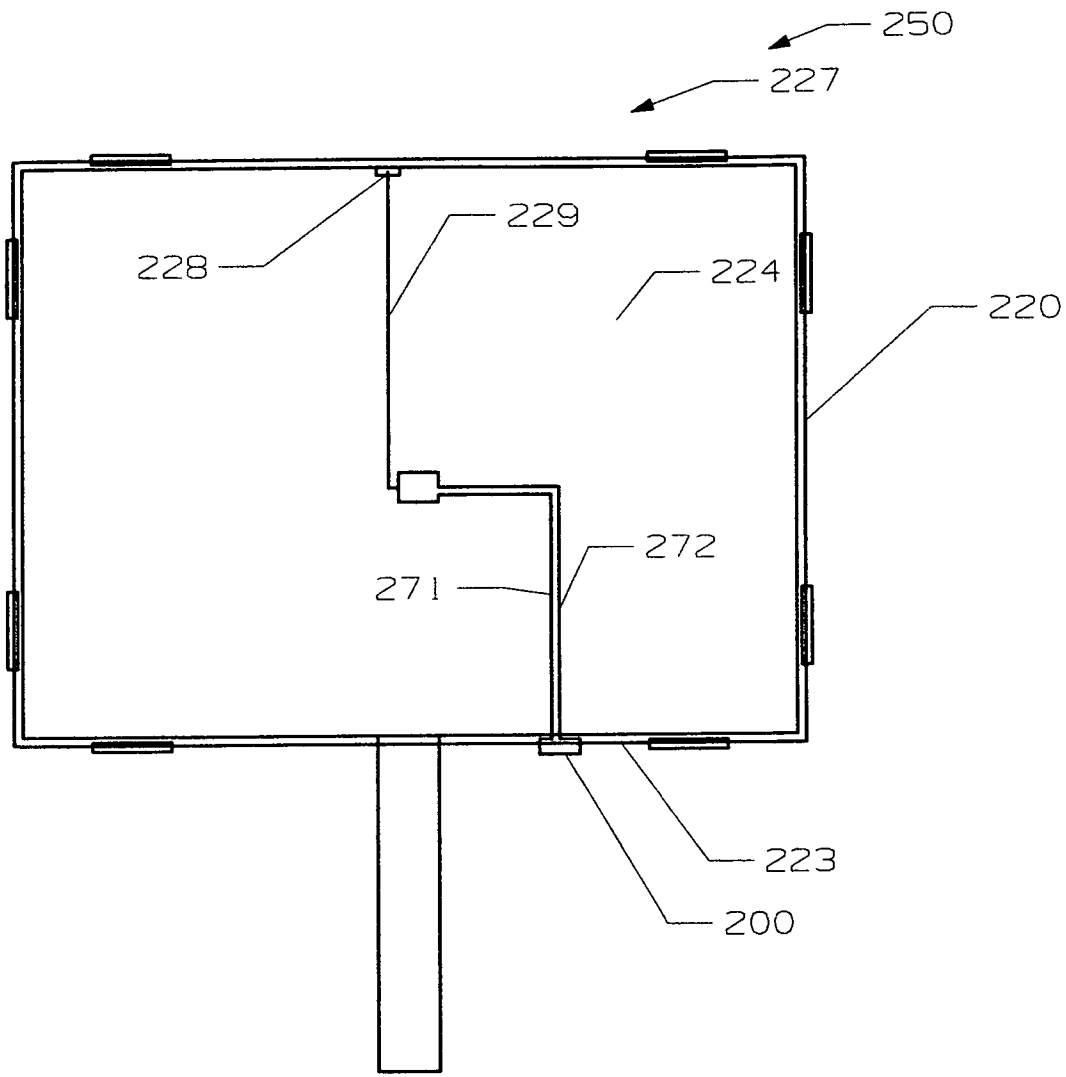
FIG. 5D provides an extension of the fourth embodiment wherein a controller communicates with an active telephone system of the structure.

In an extension of the fourth embodiment, as shown in FIG. 5D, a communication line 229 connects the second input 257 to an active telephone port 228 of a telephone system 227 of the structure 220, such that controller 266 is able to communicate with the telephone system 227, and monitor outgoing telephone calls for an "emergency dial." Illustratively, the dialing of a "911" or a police department phone number, and the like, may be recognized to trigger an emergency situation. Upon the recognition of an "emergency dial," the controller 266 overrides the current routine to move the information display device 200 to a flashing routine as previously described. Once the emergency mode is triggered, operation of the illumination system 250 is substantially identical to the methods provided herein. One of ordinary skill in the art will readily recognize that this example represents only one trigger point, and that multiple trigger points may be utilized to provide a balanced and effective scheme.

While this fourth embodiment has been shown with an information filter 106, one of ordinary skill in the art will recognize that a dynamic information filter 83 or a hybrid information filter 84 may be utilized in place of the information filter 106, as described in the first embodiment.

Figure 6A:
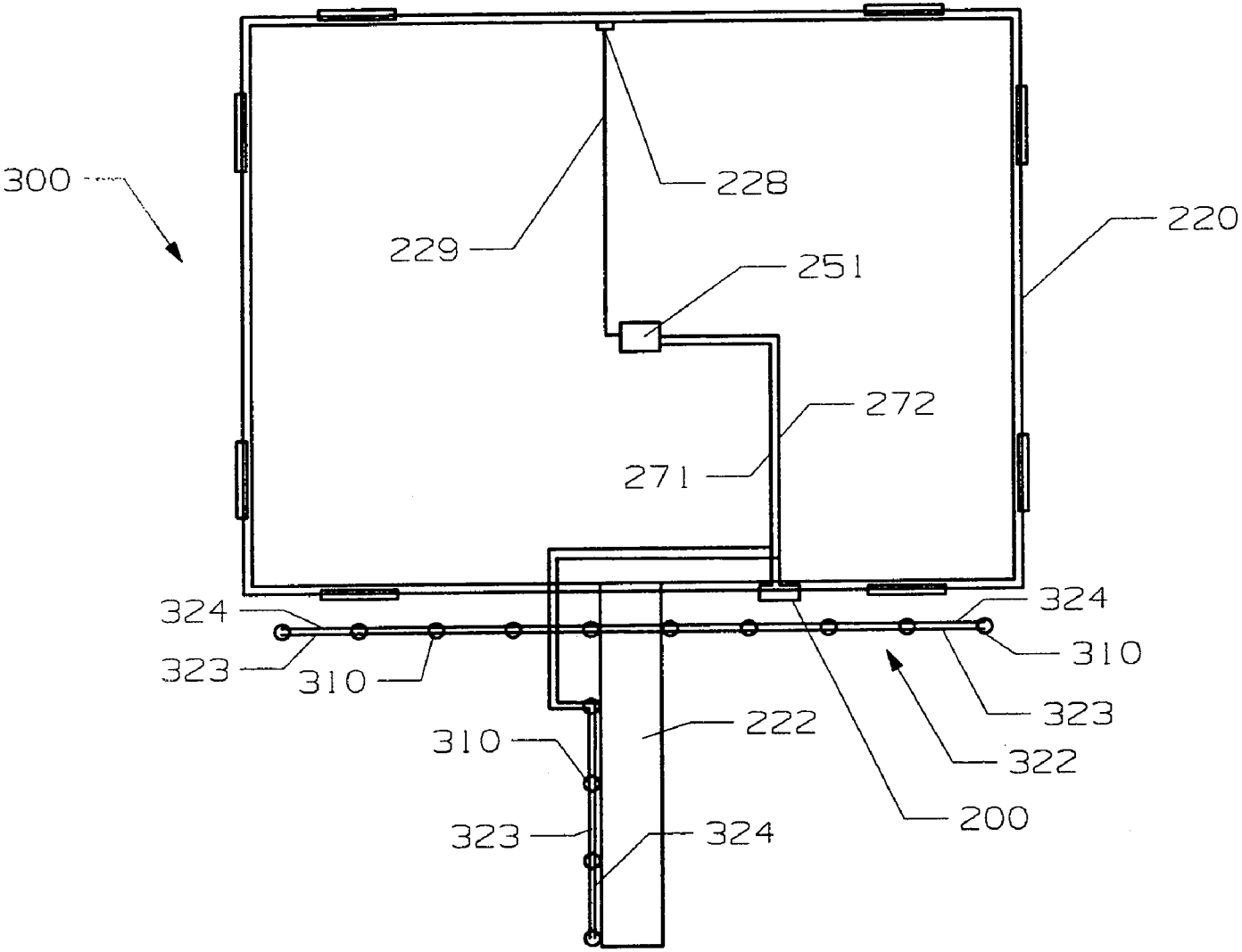
FIG. 6A provides a cross section view of the structure according to a fifth embodiment.

In a fifth embodiment, an illumination system 300 is identical to the illumination system 250 of the fourth embodiment, and accordingly, like part have been labeled with like numerals. However, the illumination system 300 further includes at least one landscape light unit 310, in communication with the control module 251, thereby extending the illumination system 300 into areas surrounding the structure 220. The illumination system 300 may further include a harness extension 322 that further includes a first electrical transmission line 323, and a second electrical transmission line 324, that are in electrical communication with the first and second electrical transmission lines 271 and 272, respectively. As shown in FIG. 6A, a structure 220 including the illumination system 300 has at least one landscape light 310 in close proximity. In this fifth embodiment, multiple landscape lights 310 are disposed adjacent to the structure 220 and along the approach strip 222. One of ordinary skill in the art will recognize that the landscape lights 310 may be placed virtually anywhere around a premise, to highlight portions of the structure 220, to illuminate the approach strip 222, to highlight vegetation, statues, or the like.

Figure 6B:
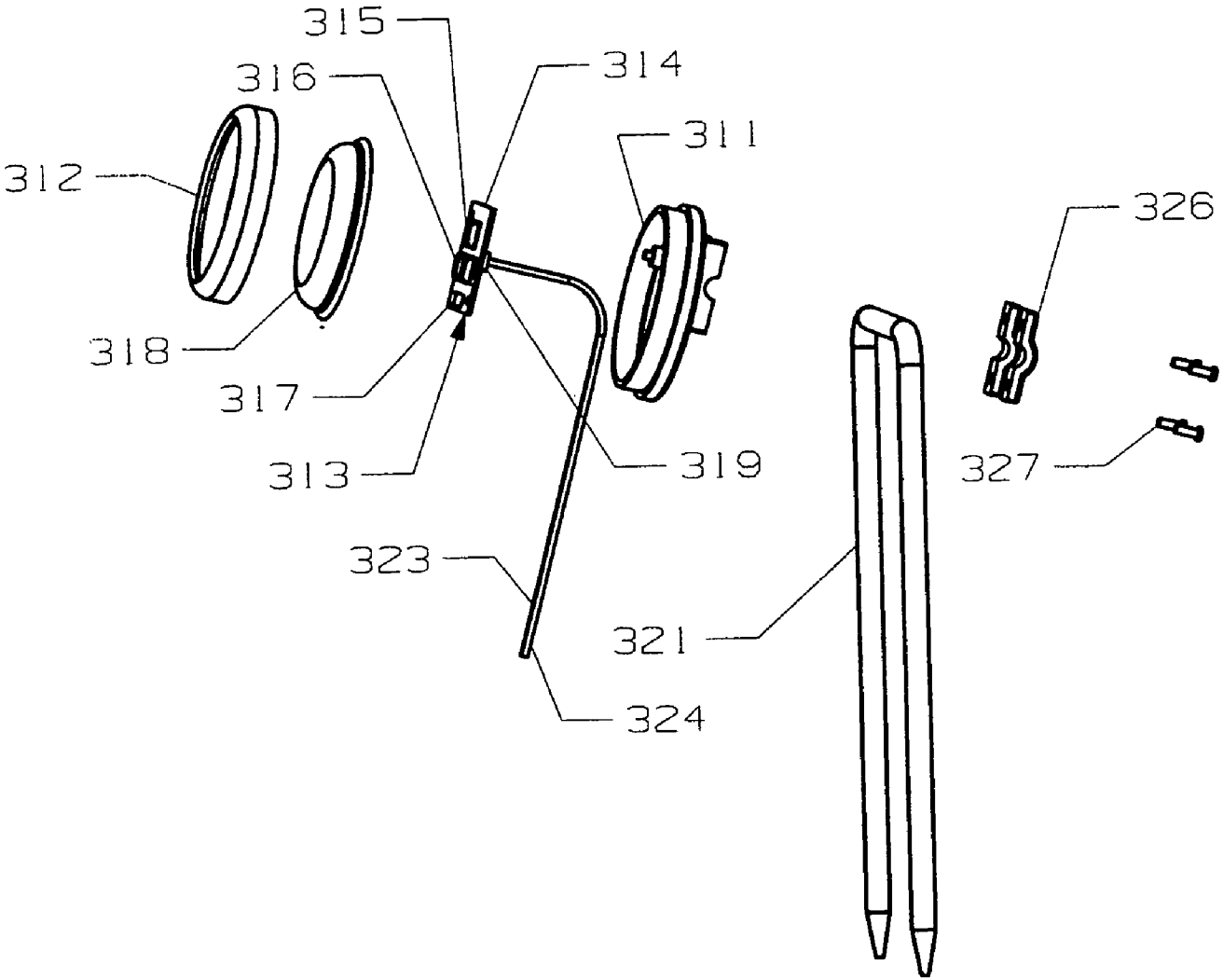
FIG. 6B provides an exploded view of a landscape light according to the fifth embodiment.

As shown in FIG. 6B, the landscape lights 310 include a housing 311, a control board assembly 313, a bezel 312, and a lens 318. The housing 311 is of a hollow cylindrical shape, and includes an interior portion complementary in size to the control board assembly 313. The housing 311 may be constructed from virtually any material, preferably from one that is ultraviolet resistant. Illustratively, in this embodiment, the housing 311 and bezel 312 are cast metal. The housing 311 may further include a stake 321 for insertion into the ground, and to support the housing 311. The stake 321 may be constructed from any structural material, such as a steel, stainless steel, plastic, or the like. The landscape light 310 further includes mounting brackets 326 and screws 327, for securing the housing 311 to the stake 321. The brackets 326 may be formed from virtually any non-corrosive material, including weather resistant resins.

The control board assembly 313 is of a shape complementary to the interior portion of the housing 311, and includes printed circuit board 314, a controller 317, a first light source 315, and at least a second light source 316. The printed circuit board 314 is well known in the art, and is utilized for connecting electrical components. The controller 317 is similar in construction to the controller 104 of the first embodiment, and is disposed onto the printed circuit board 314. The first light source 315 and the second light source 316 are substantially identical in form and color to the first light source 115 and the second light source 116, of the information display device 200, and are in communication with the controller 317, such that the controller 317 controls the power levels applied to the light sources 315 and 316. One of ordinary skill in the art will recognize that, as in the first embodiment, more than two light sources may be utilized to achieve specific results, as disclosed in the first embodiment. The landscape light 310 may further include a booster light source as disclosed in the first embodiment.

The control board assembly 313 may further include a power and communication jack 319 that includes a first contact and a second contact. In this embodiment, the first electrical transmission line 323 is in electrical communication with first contact, and the second electrical transmission line 324 is in electrical communication with the second contact. The control board assembly 313 may further include hardware required for rectifying the alternating current, such as a rectification bridge.

The lens 318 is of a hollow cylindrical shape, and includes a closed end and open end. A diameter of the lens 318 is complementary to a diameter of the housing 311, such that the open end of the lens 318 may be placed over the housing 311, and secured in place by the bezel 312. The lens 318 may be constructed from any clear material having properties suitable for light transmission, and exposure to the elements. In this embodiment, the lens 318 is constructed from a polycarbonate.

The first electrical transmission line 323 and the second electrical transmission line 324 may be any cable suitable for low voltage transmission. The first and second electrical transmission lines 323 and 324 run substantially parallel to each other, and extend from a junction point with the first and second electrical transmission lines 271 and 272, to a furthest landscape light 310. As shown in FIG. 6A, multiple legs of the first and second electrical transmission lines 323 and 324 may be utilized to extend the illumination system 300 in different directions. Illustratively, a first leg may extend down the approach strip 222, a second leg may extend down a first side of the structure 220, and a third leg may extend down a second side of the structure 220.

Assembly of the landscape light 310 commences with insertion of the circuit board assembly 313 into the housing 311. The lens 318 is then placed onto the open end of the housing 311, and the bezel 312 is then glued onto the housing 311, such that the lens 318 is captured, and an interior portion of the assembly is protected from the environment. Next, the stake 321 is placed into the alignment recesses disposed on the housing 311, and the brackets 326 are located over the stake 321. Upon installation of the screws 327, the brackets 326 and the stake 321 are secured to the housing 311.

Once assembled, the landscape light 310 may be rotated about the stake 321, thereby providing vertical angle adjustment. Adjustment in the horizontal plane must be accomplished by rotating the stake relative to an object being lit.

In use, landscape lights 310 are disposed at a predetermined spacing or a preferred spacing, along the first and second electrical transmission lines 323 and 324, such that the first and second electrical transmission extensions contact each landscape light 310 at the power and communication jack 319 of each landscape light 310, and the landscape lights 310 are disposed in parallel. In this fashion, the control module 251 continuously delivers exactly the same power and communication signals to the information display device 200 and the landscape lights 310.

In operation, the control module 251 delivers an alternating current to the information display device 200 and the landscape lights 300. The alternating current is rectified on the landscape lights 310 and the illumination display device 200. Accordingly, the information display device 200 and the landscape lights 310 simultaneously execute identical phase routines, lock on color routines, and alarm flashing routines. The illumination system 300 produces a synchronized, controlled phasing of all the illumination system 300 components. A user may then lock the illumination system 300 onto a desired color, and in the case of emergencies, the user may actuate the alarm actuator 290 to commence a warning routine, wherein the controller 266 directs the components to flash using red lights, thereby denoting an emergency situation.

One of ordinary skill in the art will recognize that it is possible to utilize varying types of light sources for the information display device 200 and the landscape lights 310; however, is should be noted that a same color scheme must be represented between the information display device 200 and the landscape lights 310, such that equivalent color displays are executed in both devices.

In a sixth embodiment, a sign 400 includes a control board assembly 403, a light pipe 402, and an information filter 406. The control board assembly 403 is similar in form and function to the control board assembly of the previous embodiments, and includes a controller 404 and at least one first light source 415. As described in previous embodiments, additional light sources may be utilized in a same color or different colors to form a light bank 428. In this particular example of the sixth embodiment, the light sources 415 are light emitting diodes of a same color, and are disposed in a light bank 428 on the control board assembly 403. The light pipe 402 is similar to the light pipes of the previous embodiments, and includes a receiving surface 442 and an emitting surface 432. In this specific example, the light sources 415 disposed in the light bank 428 deliver light to the light pipe 402 through the receiving surface 142. The information filter 406 is similar to the information filters of the previous embodiments, and includes at least one information port 433, whereby the light pipe 402 may be seen through the information port 433, and in the shape of the information port 433 when the light pipe 402 is illuminated. In this specific example, the information filter 406 is complementary in shape to the light pipe 402, and delivers visual information as described in the previous embodiments. As described in the previous embodiments, multiple information ports 433 may be utilized to deliver varying types of visual information.

The information filter 406 may be any form of opaque layer that is secured in place in front of the light pipe 402. Alternatively, the information filter 402 may be directly applied to the emitting surface 432 of the light pipe 402. Illustratively, the information filter 402 may be a laser cut film that includes an adhesive, or the information filter 406 may be painted onto the emitting surface 432.

As described in the previous embodiments, the control board assembly 403 is in electrical communication with a power supply. In this specific example, the power supply is an alternating current that is rectified. One of ordinary skill in the art will recognize that virtually any form of electrical power source is possible, dependent upon environmental situations. Illustratively, the sign 400 may be powered by batteries, solar power, and the like.

In operation, the sign 400 may be utilized to deliver visual information to viewers. As described in the previous embodiments, the controller 404 regulates the delivery of power to the light sources 415 disposed in the light bank 428 to illuminate the light pipe 402 in a first color of the first light sources 415. The light pipe 402 is then visible in the first color and in the shape of the information port 433 through the information port 433, thereby delivering visual information.

In use, the sign 400 delivers visual information to viewers, including alphanumeric characters, logos, addresses, billboard information, and the like.

While this embodiment has been shown with a multitude of first light sources 415 disposed in a light bank 428 and delivering light in a first color, the previous embodiments of this disclosure provide for delivering light in multiple colors through the use of the first light source 415, a second light source 416 of a second color, and possibly a third light source 417 of a third color. Accordingly, the sign 400 may deliver the phasing, flashing, color lock, and the like, as described in the previous embodiments.

Figure 7A:
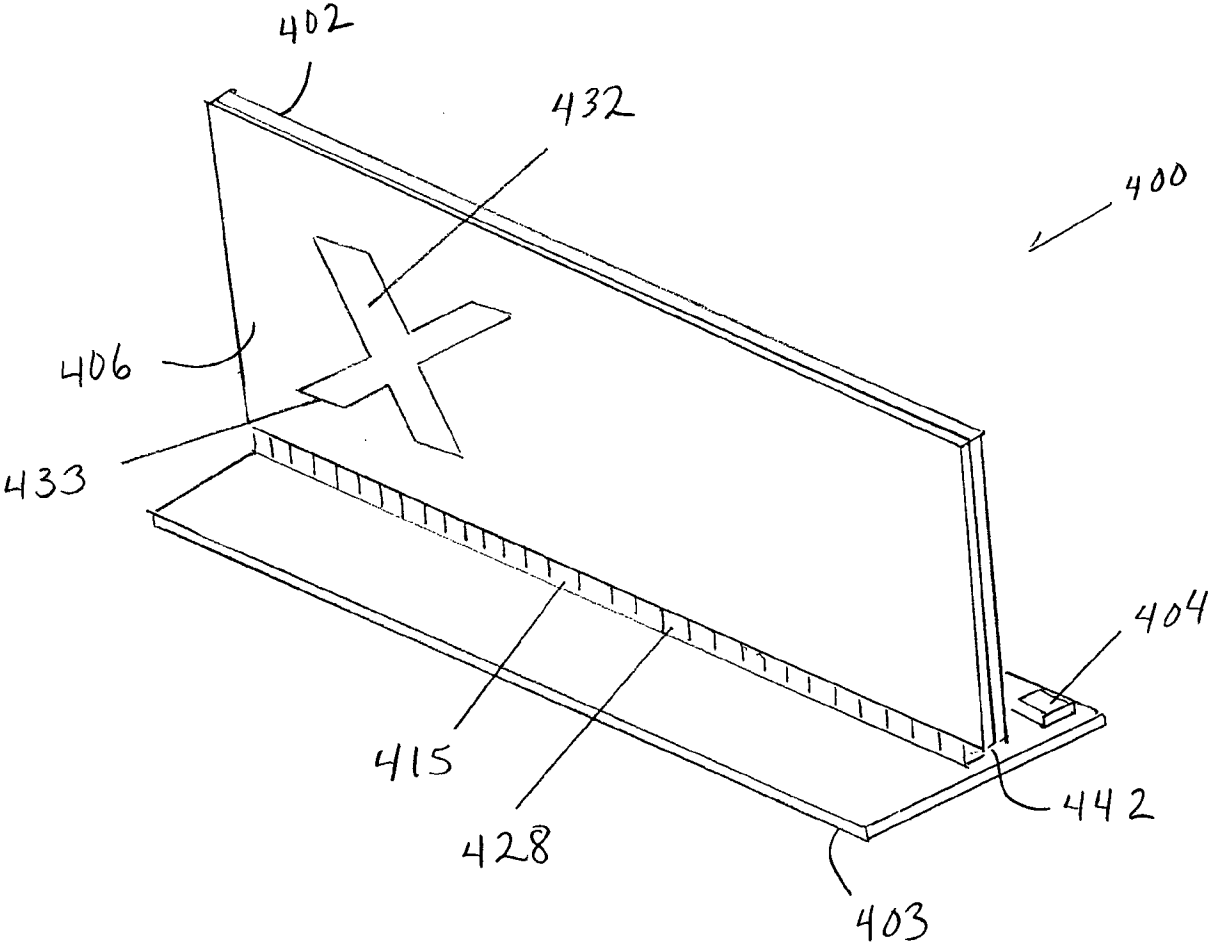
FIG. 7A provides a perspective view of a sign according to a sixth embodiment.
Figure 7B:
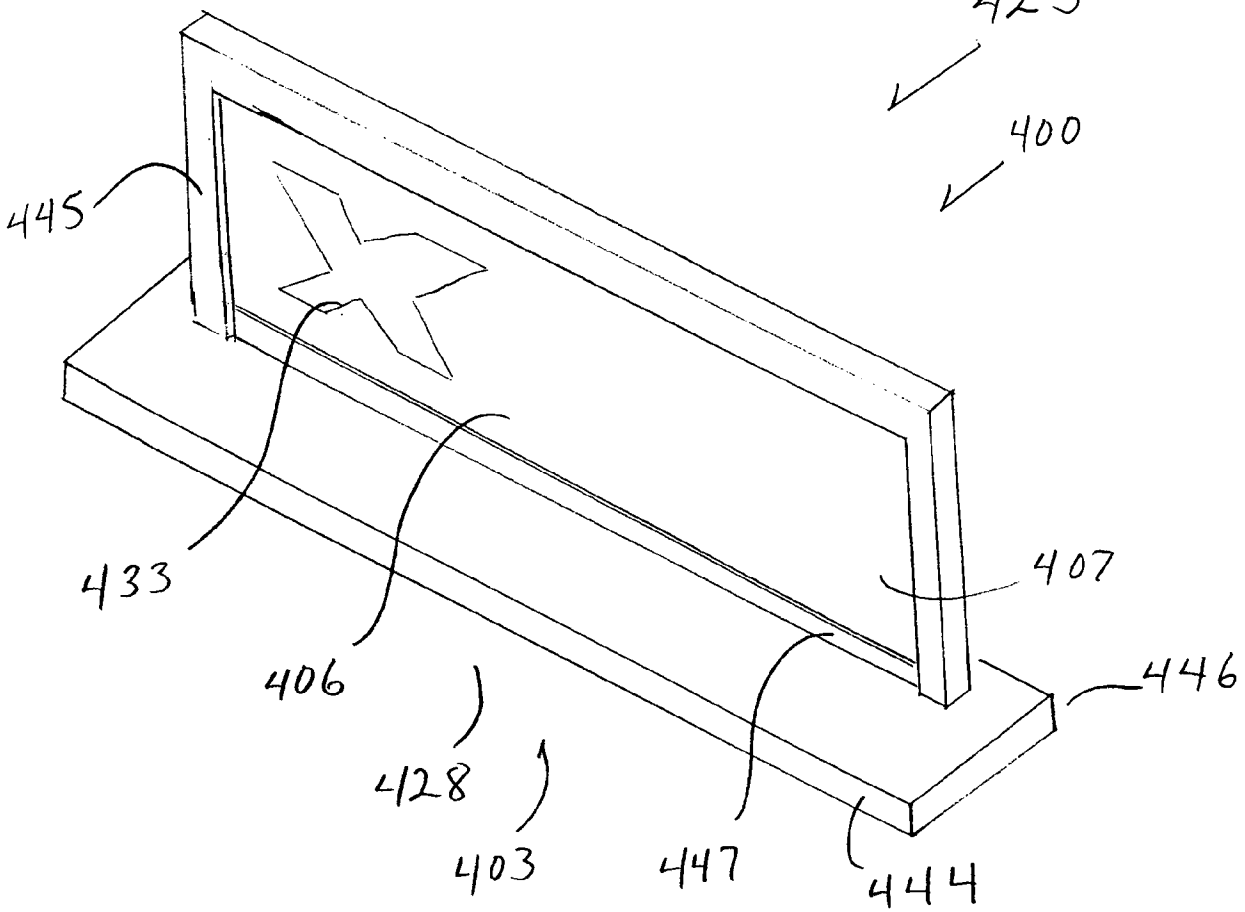
FIG. 7B provides a perspective view of the sign including a housing according to an extension of the sixth embodiment.

In an extension of the sixth embodiment, a sign 425 includes all of the components of the sign 400, and accordingly, like parts have been labeled with like numerals. The sign 425 further includes a lens 407, a base 444 and a closeout 445. The lens 407 is similar to the lens of the previous embodiments, and is disposed over the information filter 406. The base 444 is of a shape complementary to the control board assembly 403 and the light pipe 402 in an assembled position, and closes out the transition between the light bank 428 and the light pipe 402. As shown in FIG. 7B, the base 444 includes a lower section 446, a raised section 447, and a passage 448. The raised section 447 is of a rectangular cross section, and of a size complementary to the size of the light pipe 402, such that a lowest edge of the light pipe 402 and a lowest edge of the information filter 406 are disposed within the passage 448. The base 444 drains away from the raised section 446 to the outer edges, such that errant liquids move from the raised section 447 to the lower section 446.

The closeout 445 includes a lip 441 that extends along any exposed edges of the light pipe 402 and the information filter 406. A cross section of the lip 441 is complementary in size to a cumulative thickness of the light pipe 402, the information filter 406, the lens 407, and the thickness of the raised sections 447. The closeout 445 minimizes the loss of light through the edges of the light pipe 402, and protects the edges of the sign 425 from damage and errant liquids. The closeout 445 further includes a planar shield 443. The shield 443 may be a separate component, or may be formed integrally with the closeout 445. In this particular example, the shield 443 is formed as part of the closeout 445.

Figure 7D:
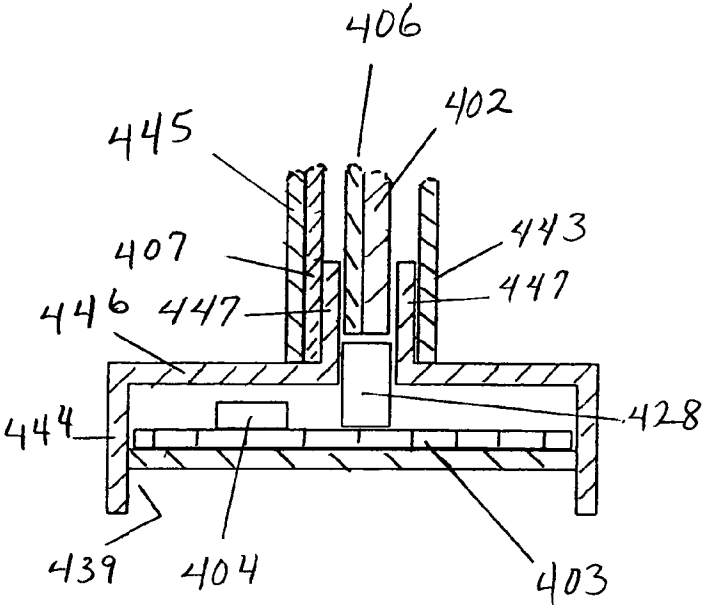
FIG. 7D provides a section view of the sign according to the extension of the sixth embodiment.
Figure 7C:
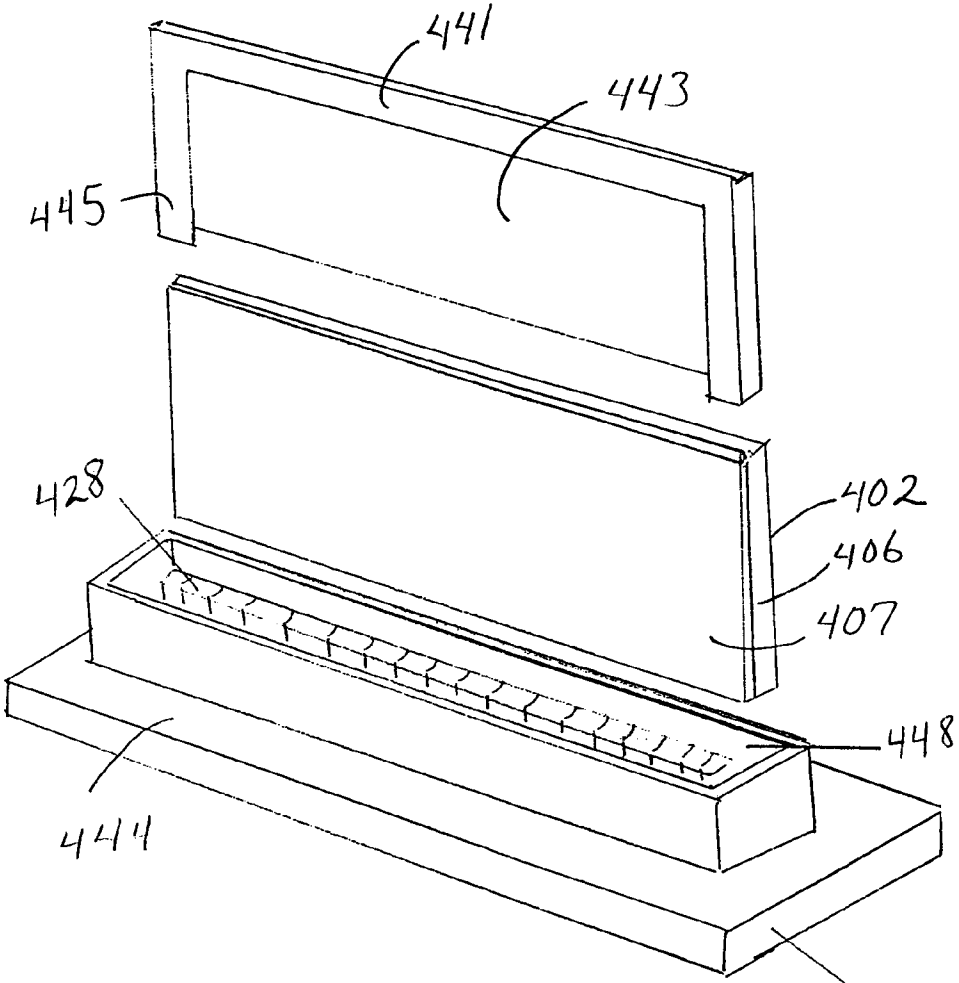
FIG. 7C provides an exploded view of the sign according to the extension of the sixth embodiment.

On assembly, the base 444 is placed over the control board assembly 403, and the light pipe 402 and the information filter 406 are inserted into the passage 448, such that the receiving surface 442 of the light pipe 402 is disposed over the light bank 428. Next, the lens 407 is placed over the emitting surface 432 of the light pipe 402, such that the a lowest edge of the lens 407 is disposed over the raised section 447, as shown in FIG. 7D. The closeout 445 is then installed over the light pipe 402, information filter 406, lens 407, and the raised section 447 of the base 444, thereby creating a water shielding device. The sign 425 may further include a lower support 449 that seals the lower portions of the base 444. The lower support 449 may be utilized with a gasket 439.

Figure 7E:
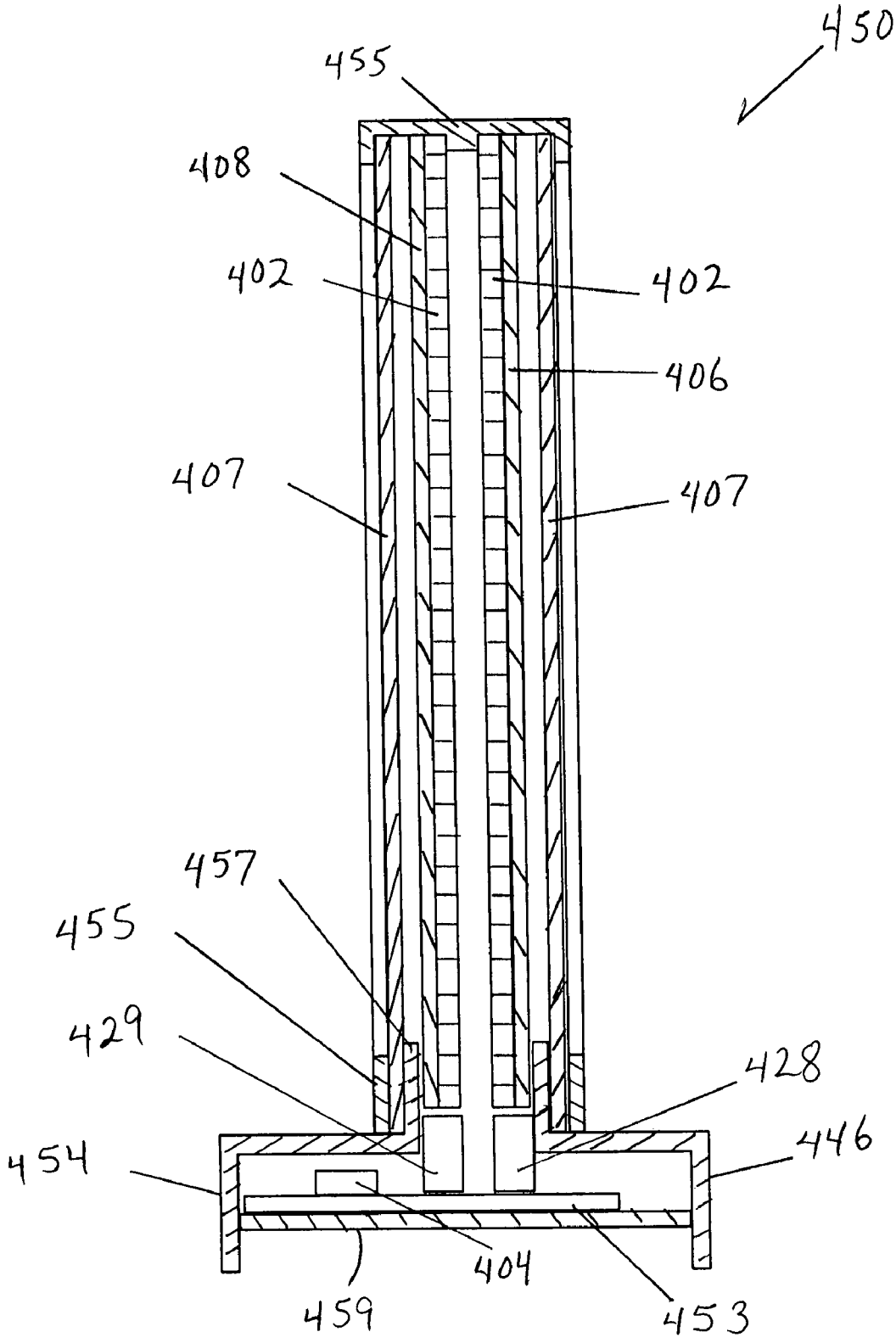
FIG. 7E provides a section view of a sign including multiple light banks according to an extension of the sixth embodiment.
Figure 7F:
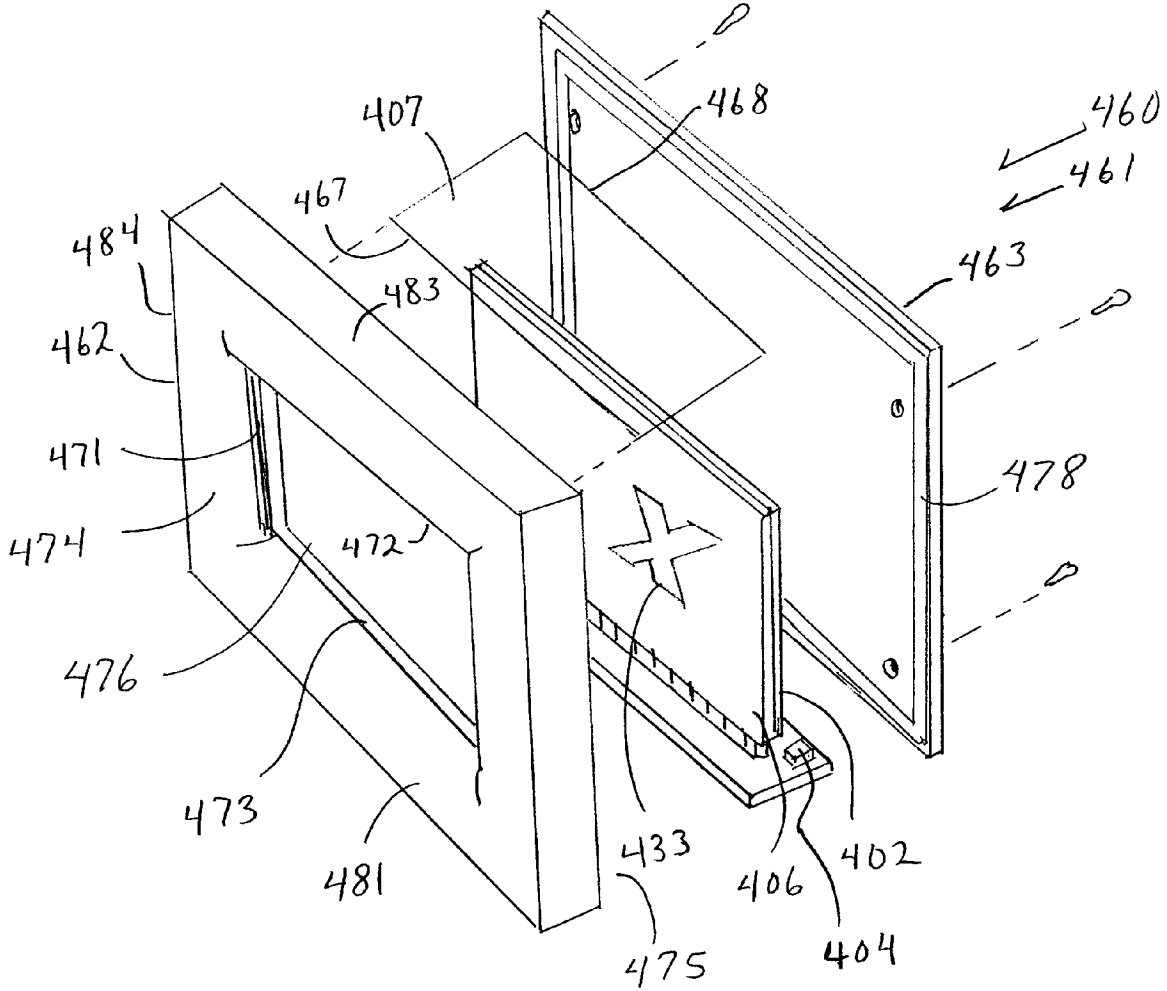
FIG. 7F provides an exploded view of another extension of the sixth embodiment.

In an extension of the sign 425, a sign 450 provides the ability to view the sign 425 from opposite sides of the device. The sign 450 includes all of the components of the sign 400, except for the control board assembly 403, and accordingly, like parts have been annotated with like numerals. In this extension of the sixth embodiment, the sign 450 includes two information filters 406 facing opposite directions. The sign 450 further includes a base 454, a closeout 455, and a control board assembly 453. The control board assembly 453 is similar in form and function to the control board 403 of the sixth embodiment, however the control board assembly 453 includes a first light bank 428 and a second light bank 429 disposed substantially parallel to each other, whereby the first light bank 428 delivers light to a first light pipe 402, and the second light bank 429 delivers light to a second light pipe 412. As shown in FIG. 7E, the control board assembly 453 is disposed within the base 454 in similar fashion to the sign 425, wherein the control board assembly 453 is housed within a lower section 446 of the base 454, and a raised section 457 extends from the lower section 456 to encapsulate the first and second light pipes 402 and 412, and the information filters 406.

In this extension of the sixth embodiment, a first information filter 406 and a second information filter 408 are disposed outside of the light pipes 402, and beneath the lens 407. In this position, the information filters 406 and 408 are protected from debris, and the light pipes 402 are visible through the information ports 433, when a respective light pipe 402 is illuminated. The closeout 455 is similar in form and function to the closeout 445 of the sign 425, however the closeout 455 does not include a shield to close out a rear portion, as the sign 450 delivers visual information in opposite directions. The closeout 455 is disposed over the lens 407 to provide a water shielding capability as described in the disclosure for the sign 425. Accordingly, the sign 450 is water resistant.

Operation of the sign 450 is substantially identical to the previous extension of the sixth embodiment, and may further conduct any phase routine, flashing, and the like as described in the previous embodiments. The controller 404 in the sign 450 may direct the first and second light banks 428-429 to conduct identical routines, or may direct the first and second light banks 428-429 to conduct different routines, display different colors, or the like. One of ordinary skill in the art will recognize that the first and second information filters 406 may display the same visual information, or may deliver different visual information.

While this extension of the sixth embodiment has been shown with a single control board assembly 453 having a first light bank 428 and a second light bank 429, one of ordinary skill in the art will recognize that multiple circuit board assemblies may be utilized, wherein each circuit board assembly includes a single light bank.

While this example is shown with two signs 400 facing opposite directions, one of ordinary skill in the art will recognize that virtually any direction, or orientation, may be utilized.

In yet another extension of the sign 425, a sign 460 includes a control board assembly 403 including a controller 404 and a light bank 428, a light pipe 402, and an information filter 406 having at least one information port 433, as described in the previous embodiments. The sign 460 further includes a housing 461 having a frame 462 and a rear closeout 463. In this specific example of the extension of the sixth embodiment, the frame 462 is rectangular in shape, and includes first through fourth legs 481-484, that have a concave section 475, and a passage 476 disposed between the legs 481-484. Each leg 481-484 of the rectangle includes a raised section 474 and a planar section 473. The raised section 474 is complementary in size to the control board assembly 403, such the control board assembly 403 may be housed within one of the legs 481-484. In this specific example, the control board assembly 403 is disposed within the first leg 481, such that the light bank 428 is facing toward the passage 476.

The planar section 473 is disposed substantially parallel to the light pipe 402 in an installed position, and extends from the first through fourth legs 481-484 approximately one half of an inch. The light pipe 402 and the information filter 406 may be pressed against the planar section 473 such that the information filter 406 is visible through the passage 476 when the sign 460 is assembled. The frame 462 further includes channels 471 disposed on the second and fourth legs 482 and 484, slightly offset from the interface between the raised section 474 and the planar section 473. The frame 462 still further includes a slot 472 disposed on the third leg 483 at the interface between the raised section 474 and the planar section 473. The slot 472 is complementary in width to a lens 407 thickness, and in length, to a lens 407 length. Accordingly, the lens 407 may pass through the slot 472 and stop upon contact with the first leg 481. The lens 407 is similar in form and function to the lens 407 of the previous embodiments, and includes a first end 467 and a second end 468. In this fashion, the internal components of the sign 460 are protected from errant fluids.

The rear closeout 463 is substantially planar, and is of a size complementary to the frame 462, such that the rear closeout 463 abuts the frame 462 and is secured to the frame with fasteners. The rear closeout 463 may be utilized with a gasket 478.

On assembly, the first end 467 of the lens 407 is inserted through the slot 472 from the concave section 475 to the passage 476, such that the lens 407 is disposed within the channels 471, and slides downward until the lens 407 comes to a stop upon contact with the first leg 481. Next, the light board assembly 403, the light pipe 402, and the information filter 406 are placed into their respective positions, such that the light pipe 402 and the information filter 406 abut the planar section 473 of the frame 462, and the information filter 406 is visible through the passage 476. The rear closeout 463 and the gasket 478 may then be secured to the frame 462, thereby securing the sign 460 components in place.

In use, the sign 460 delivers visual information to viewers when the light pipe 402 is illuminated and an information filter 406 is in place. The sign may include virtually any features employed in the previous embodiments, including, phasing, flashing, color lock, and the like.

Figure 7G:
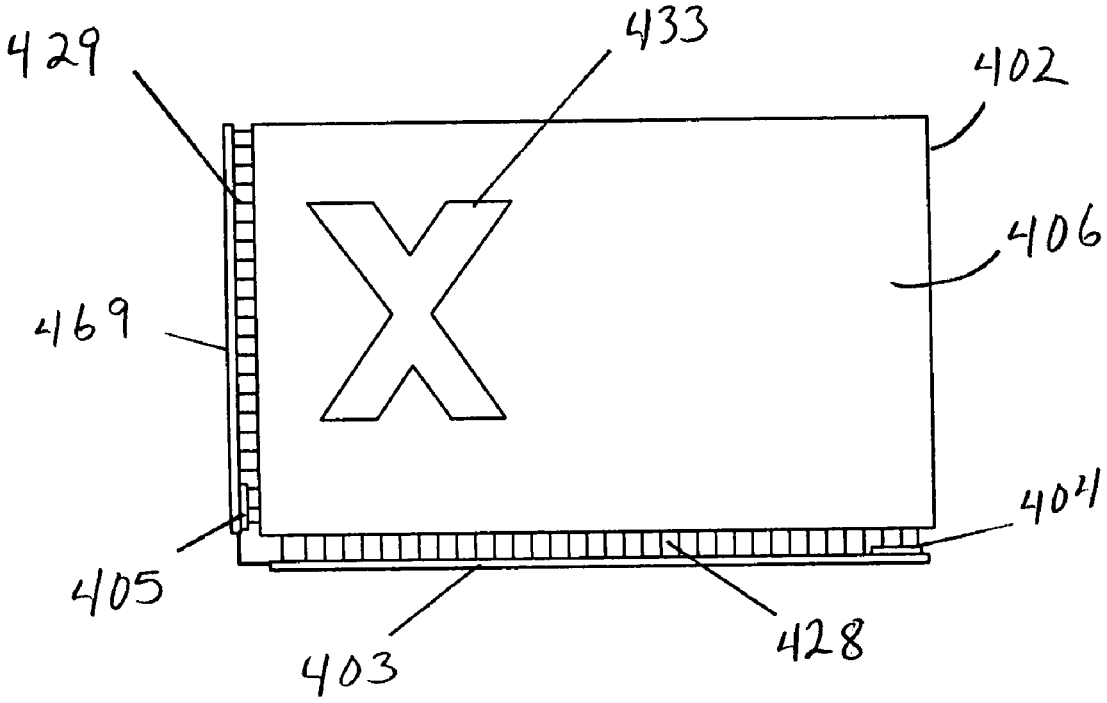
FIG. 7G provides a front view of a sign including multiple light banks according to the extension of the sixth embodiment.
Figure 7H:
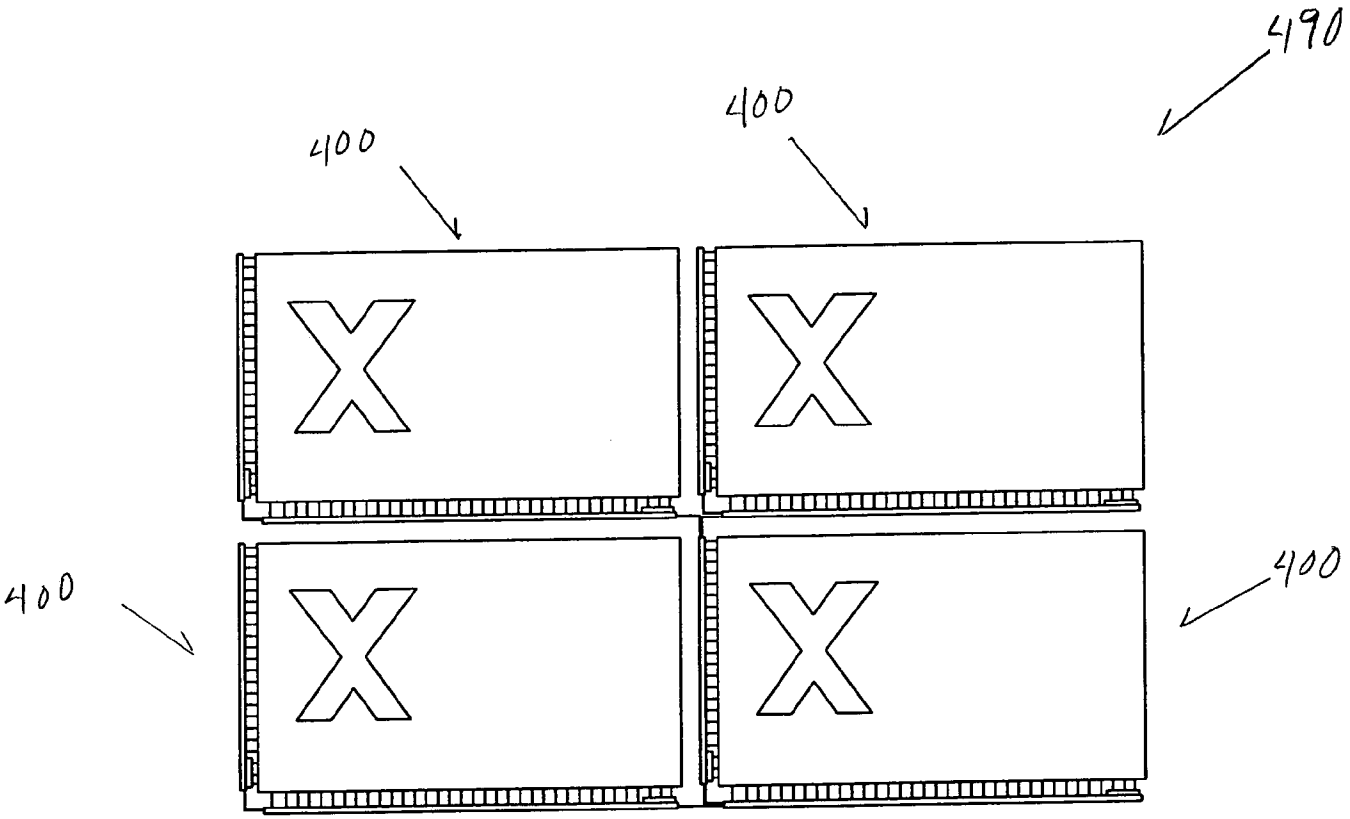
FIG. 7H provides a front view of multiple signs disposed in an array according to an extension of the sixth embodiment.

Alternatively, the sign 460 may include a second control board assembly 469 in electrical communication with the light board assembly 403 described. In this extension of the sign 460, the light pipe 402 is illuminated on multiple sides, as shown in FIG. 7G. The second control board assembly 469 includes a second light bank 429, and may include a second controller 405. The second control board assembly 403 fits into an unused leg of the housing 461. Illustratively, in this specific example the second control board assembly 469 is disposed within the fourth leg 484 of the housing 461.

Assembly of this extension of the sign 460 is substantially identical to the assembly of the sign 460, and therefore will not further be described.

Use of this extension of the sign 460 is similar to the sign 460, however the controllers 404 and disposed on the control board assembly 403 and 469 may operate all of the light banks 428-429 identically, or they may operate independently. Alternatively, a single controller may operate as a master controller, and the remaining controller may operate as a slave, thereby delivering consistent colors and patterns.

In a further extension of the sign 460, a sign 490 includes multiple signs 400 disposed in an array. In this configuration, the control board assemblies 403 are in electrical communication with each other. Accordingly, the signs 400 may be run synchronously or asynchronously. One of ordinary skill in the art will recognize that a single controller may be utilized as a master controller, wherein the remaining controllers receive and execute commands from the master controller.

One of ordinary skill in the art will further recognize that the sign 490 may be operated in identical fashion to the residential illumination system of the previous embodiment, wherein the landscape lights are driven by a control module. In such a case, the control module could act as the master controller.

While this sixth embodiment has been shown with an information filter 406, one of ordinary skill in the art will recognize that a dynamic information filter 83 or a hybrid information filter 84 may be utilized in place of the information filter 406, as described in the first embodiment.

In a seventh embodiment, a sign 500 includes a housing 501 having a pedestal 511 and a base 512, and a control board assembly 503 having a controller 504. The sign 500 further includes an information filter 506, a light pipe 502, and a lens 507. The light pipe 502 is substantially identical to the light pipes of the previous embodiments, and is similarly rectangular in shape. The light pipe 502 includes a receiving surface 515 and an emitting surface 516, as described in the previous embodiments. The lens 507 is preferably rigid in this embodiment and of a size complementary to the light pipe 502. In this embodiment, spacers 513 are disposed between the light pipe 502 and the lens 507 to create a cavity 510 between the light pipe 502 and the lens 507. In this specific example, the spacers 513 are approximately one hundred thousandths of an inch thick, and are disposed at a first end 517 and a second end 518 of the light pipe 502, thereby creating the cavity 510 in the same thickness, and of a height substantially equivalent to a distance between the pedestal 511 and the first end 517 of the light pipe 502. The light pipe 502 and the lens 507 are secured to the spacers 513 to create a lens assembly 520. In this specific example, adhesives are used to secure the light pipe 502 to the lens 507.

The pedestal 511 includes a rectangular cross section having a passage 521 for accepting the lens assembly 520. The pedestal 511 is hollow and is complementary to the control board assembly 503. The base 512 is substantially planar, and of a size complementary to the footprint of the pedestal 511, such that the base 512 closes out a lower portion of the pedestal 511 to protect the control board assembly 503. A gasket similar to gasket 439 may be utilized in adverse weather conditions.

The passage 521 is disposed in alignment with a light bank 528 of the control board assembly 503, such that the receiving surface 515 of the light pipe 502 is disposed in proximity to the light bank 528.

The information filter 506 is similar to the information filter of the previous embodiments, wherein the information filter 506 includes at least one information port 533 for delivering visual information. However, in this seventh embodiment, the information filter 506 is replaceable. The information filter 506 is of a size complementary to the height of the cavity 510, and a width similar to a width of the light pipe 502.

On assembly, the second end 518 of the light pipe 502 is inserted into the passage 521 until the receiving surface 515 of the light pipe 502 is disposed adjacent to the light bank 528. Next, the information filter 506 is inserted into the cavity 510, such that the information ports 533 display accurate information when the light bank 528 is powered and the light pipe 502 is illuminated.

In use, the controller 504 regulates the delivery of power from a power source to the light bank 528. The light bank 528 then delivers light to the receiving surface 515 to illuminate the light pipe 502. The illuminated light pipe 502 emits light of at least a single color through the emitting surface 516. The opaque information filter 506 does not let the light move to the lens 507, except through the information ports 533. Accordingly, the sign 500 delivers visual information in the shape of the information ports 533. Upon a changeout, a user may remove the information filter 506 from the cavity 510, and insert a revised or new information filter 506. Illustratively, the sign 500 may be utilized to display current information. Illustratively, the sign 500 may be utilized at a restaurant to display "today's specials," at a concert hall to display upcoming events, at a book store to display reference headings, and the like.

Figure 8A:
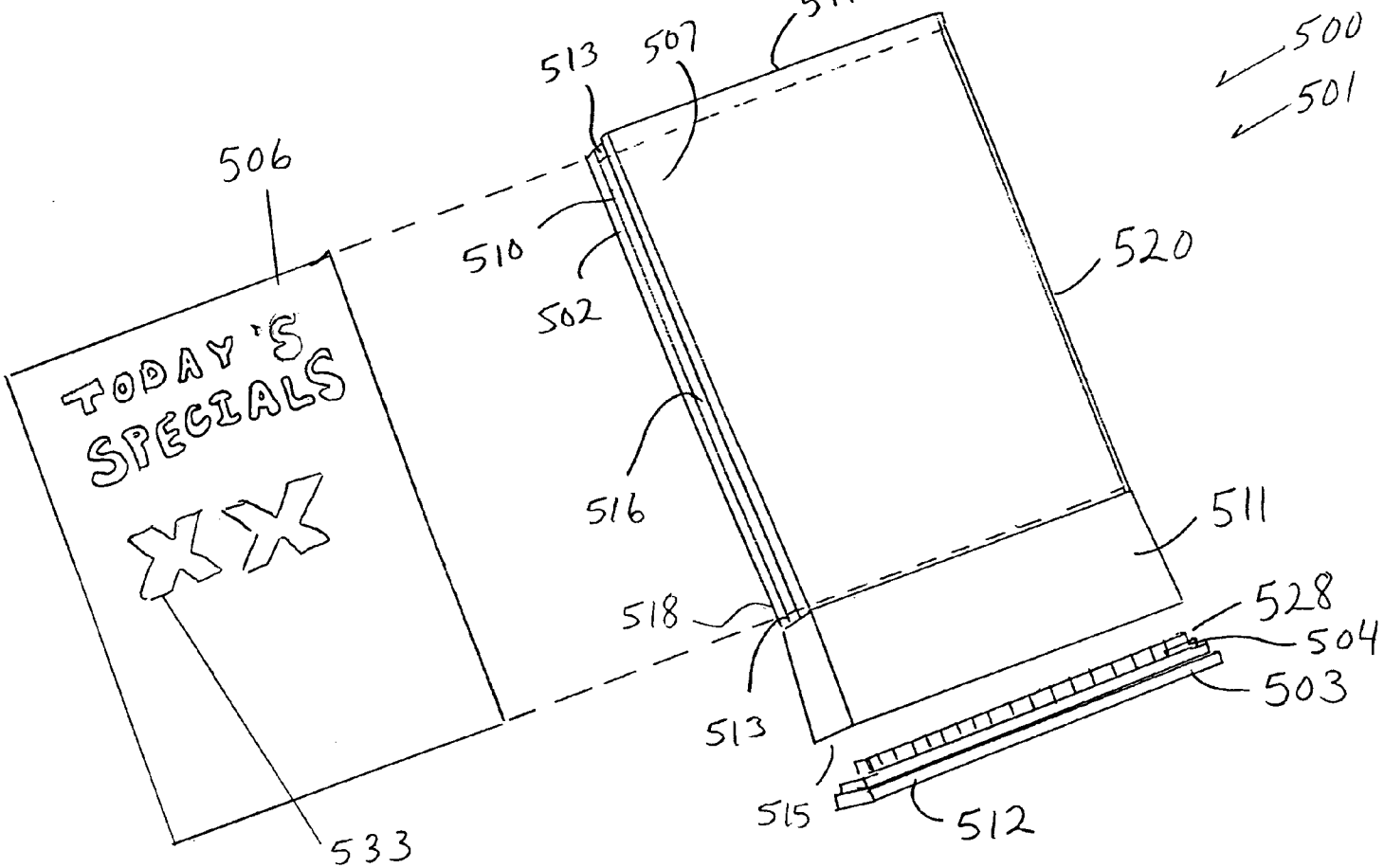
FIG. 8A provides a perspective view of a sign including a removable information filter according to a seventh embodiment.
Figure 8B:
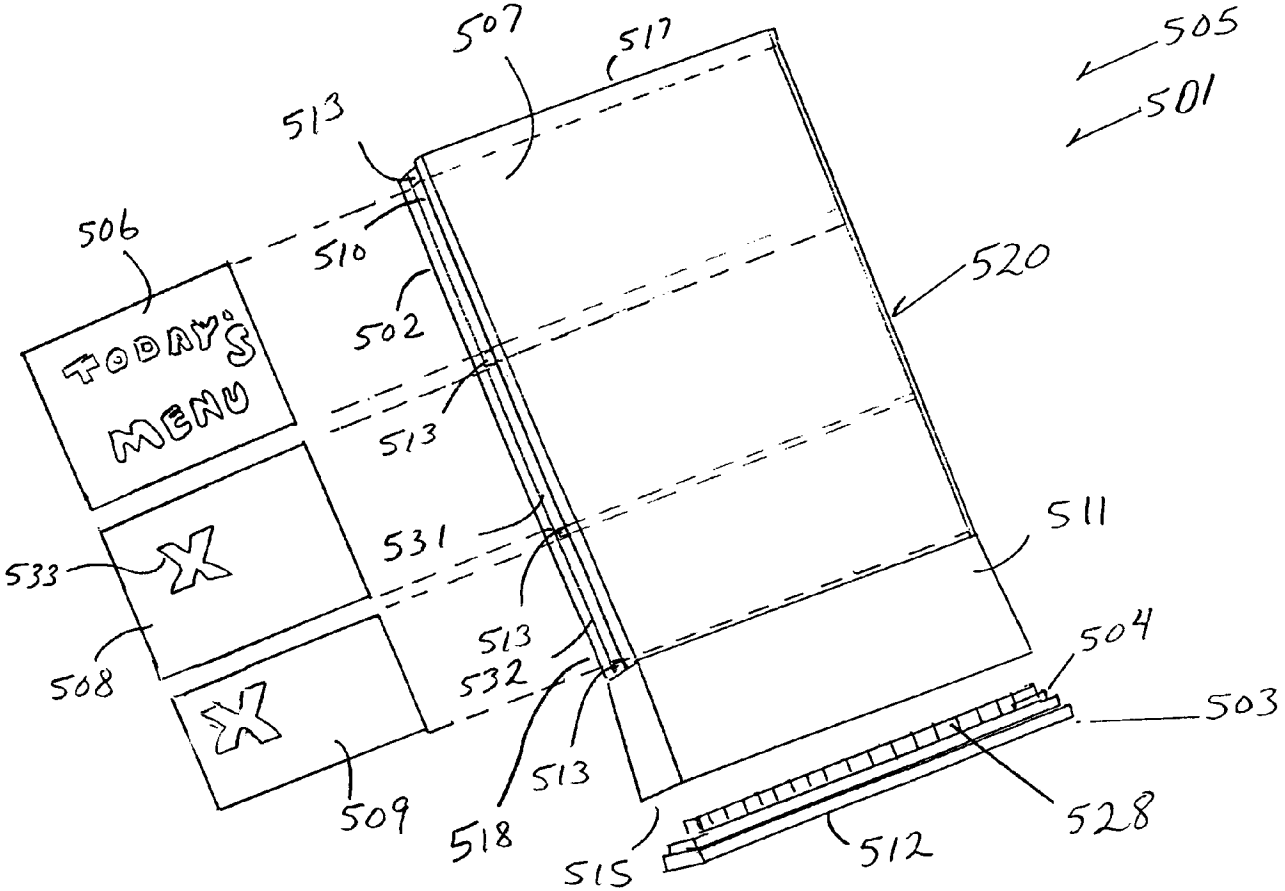
FIG. 8B provides a perspective view of a sign including multiple removable information filters according to an extension of the seventh embodiment.

In an extension of the seventh embodiment, a sign 505 includes multiple cavities and multiple information filters. As shown in FIG. 8B, the sign 505 includes spacers 513 disposed at predetermined distances from each other, thereby creating a first cavity 510, a second cavity 531, and a third cavity 532. Accordingly, the single information filter of the sign 500 is then replaced with a first information filter 506, a second information filter 508, and a third information filter 509, each of which may includes information ports 533, as required. Accordingly, one or more of the information filters 506, 508 or 509 may be removed and replaced as required.

Operation and use of the sign 505 is substantially identical to the sign 500, and therefore will not be further described.

Figure 8C:
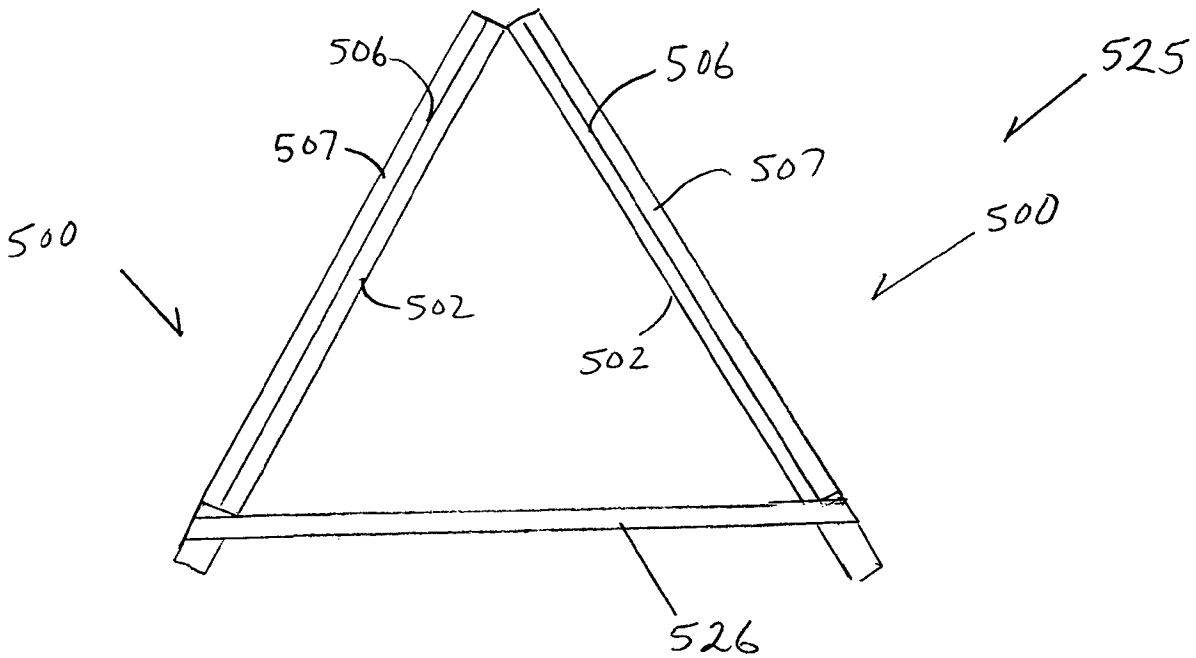
FIG. 8C provides a frontal view of sign disposed in relation to one another according to an extension of the seventh embodiment.

In an extension of the seventh embodiment, a sign 525 includes multiple faces for displaying information. As shown in FIG. 8C, two signs 500 are disposed in a back-to-back position. The sign 500 further includes a restraint structure 526 disposed at a lower end to hold the signs 500 at correct viewing angles.

While this embodiment has been shown with back-to-back signs 500, one of ordinary skill in the art will recognize that the signs 500 may be disposed at virtually any angle, dependent upon the site specific conditions. One of ordinary skill in the art will further recognize that the signs 500 may be disposed adjacent to each other, as expressed in the sign 490 embodiment. In the case of a multi-panel sign, one of the controllers may act as a master controller, and the others may behave as slave controllers, as described in the sign 490.

While this seventh embodiment has been shown with an information filter 506, one of ordinary skill in the art will recognize that a dynamic information filter 83 or a hybrid information filter 84 may be utilized in place of the information filter 506, as described in the first embodiment.

In an eighth embodiment, an information display device 600 of similar construction to the signs of the sixth embodiment includes a mechanical clock 611 disposed through a light pipe 602, information filter 606, and a lens 607. The light pipe 602, information filter 606, and lens 607 are disposed above a light bank 628 as previously described. The information display device 600 further includes a housing 601 having a lower unit 614 and an upper closeout 615.

In operation, the information display device 600 delivers a time through the use of the clock 611, and any other additional information through the use of an information port 633 or a routine as described in the previous embodiments. Illustratively, the information display device 600 may phase, flash, or the like.

Figure 9A:
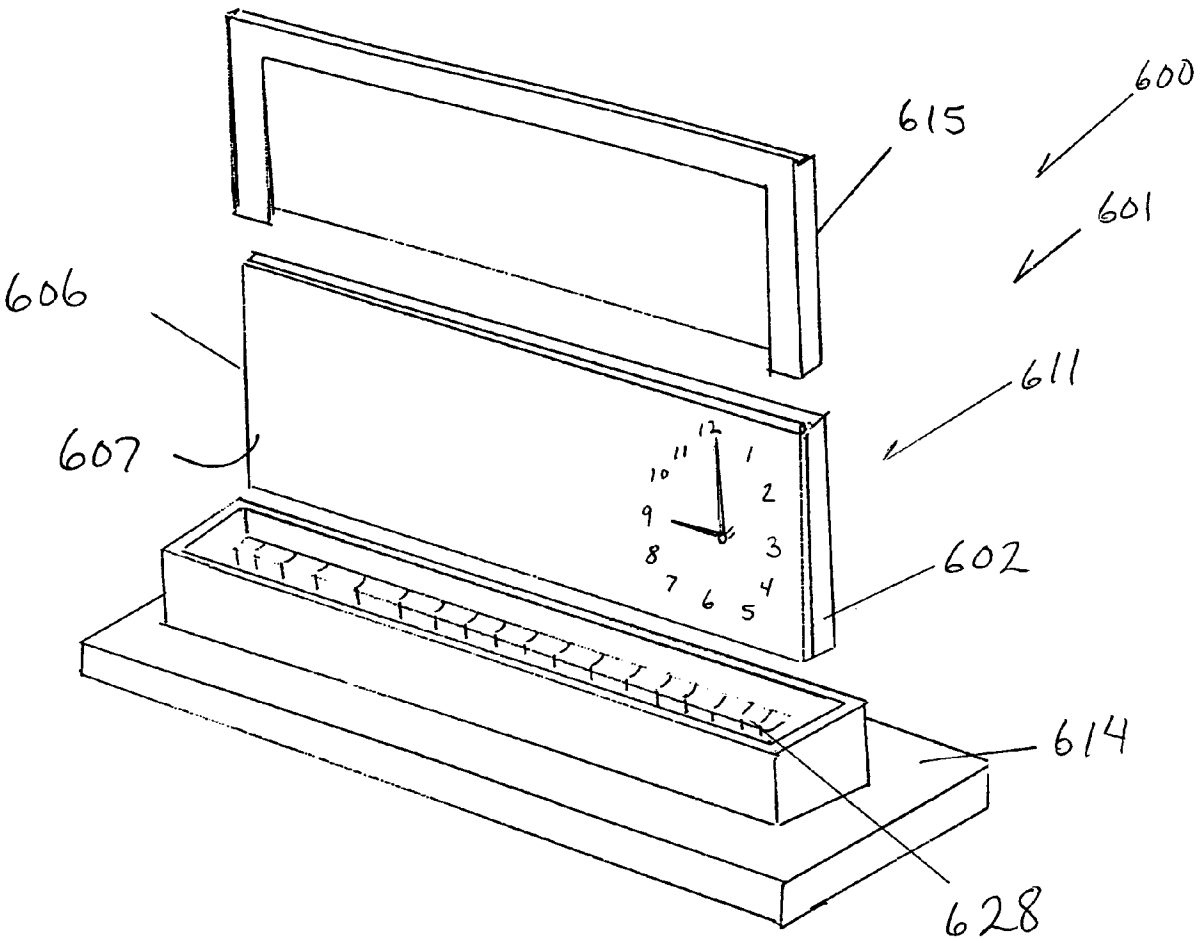
FIG. 9A provides a perspective view of an information display device including a clock according to an eighth embodiment.
Figure 9B:
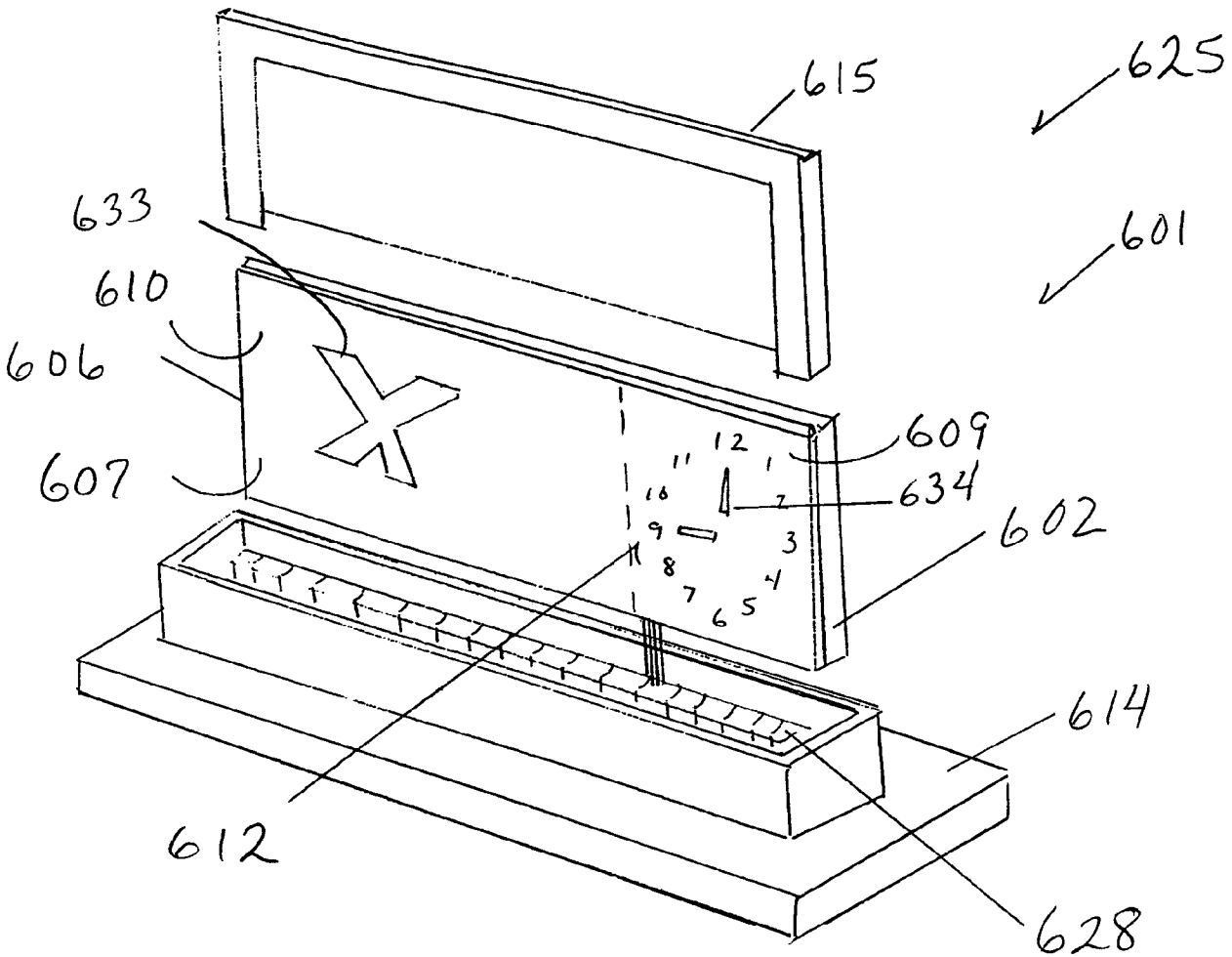
FIG. 9B provides a perspective view of the information display device including a digital representation of a clock according to an extension of the eighth embodiment.

In an extension of the eighth embodiment, an information display device 625 includes a hybrid information filter having an active portion 609 and an inactive portion 610. As shown in FIG. 9B, the inactive portion 610 may include an information ports 633 for the delivery of visual information. In this extension of the eighth embodiment, the active portion 609 includes information cells 634 that provide a digital representation of a clock face 612, and the controller provides a timing sequence for the movement of the information cells 634 in the shape of hands of the clock face 612. Accordingly, the information display device 625 delivers duration information to viewers, as well as visual information.

Figure 9C:
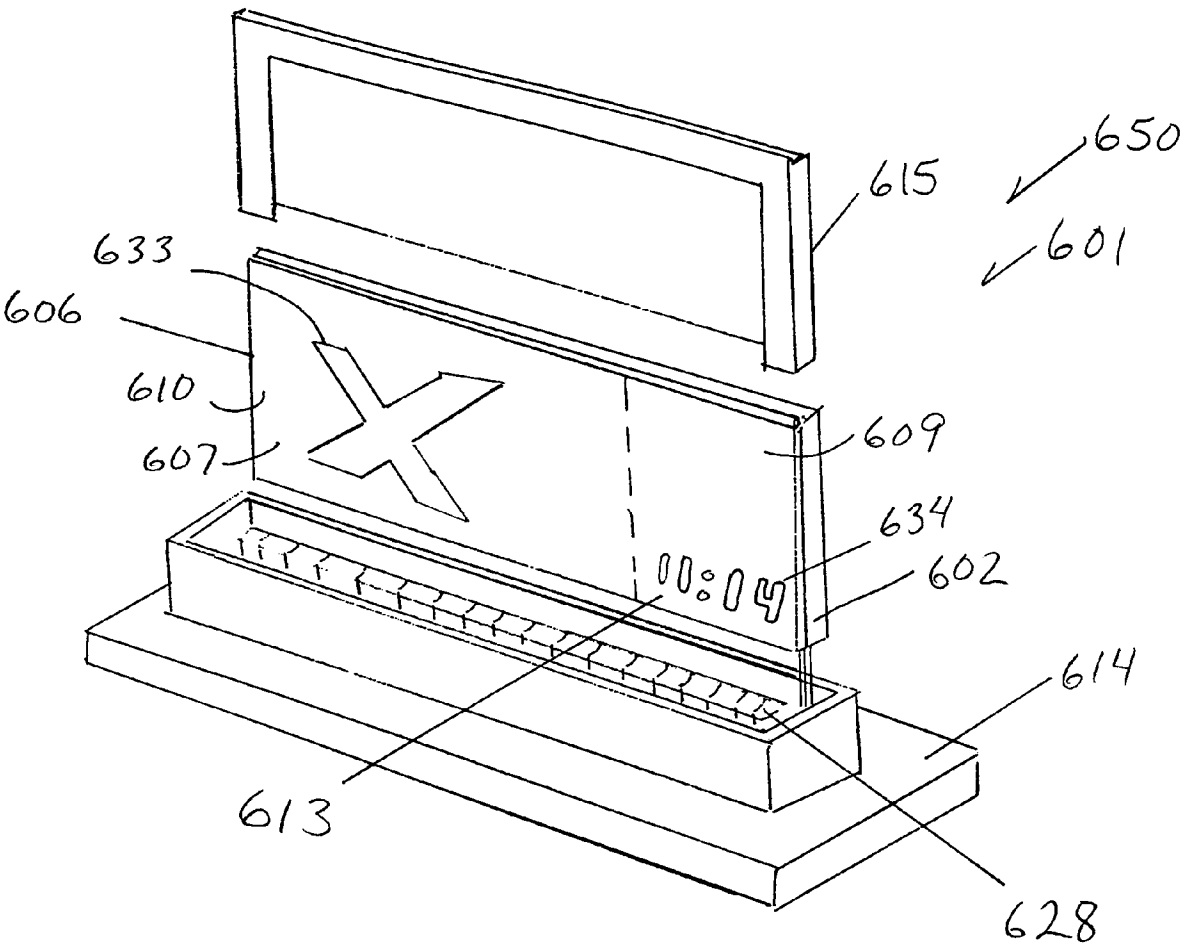
FIG. 9C provides a perspective view of the information display device including a digital clock according to a second extension of the eighth embodiment.

In a second extension of the eighth embodiment, an information display device 650 includes a hybrid information filter having an active portion 609 and an inactive portion 610. As shown in FIG. 9C, The information display device 650 is similar in design and construction to the information display device 625, however, the active portion 609 includes information cells 634 that provide a representation of a digital clock 613, whereby a controller provides a timing sequence for the changing of the digital clock 613 with real time. Accordingly, the information display device 650 delivers duration information to viewers, as well as visual information.

All other aspects of the information display device 650 are similar in construction an operation to the embodiments described herein.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A sign, comprising:

a first light source of emitting a first light of a first color; and a dynamic information filter disposed adjacent to the first light source, wherein the dynamic information filter includes an active portion having at least one information cell, and further wherein the active portion and the at least one information cell are opaque when not energized, and the at least one information cell is translucent when energized, thereby allowing the first light from the first light source to pass through the at least one information cell to deliver visual information in a shape of the at least one information cell.

2. The sign according to claim 1, further comprising:

a controller in electrical communication with a power supply, the first light source, and the dynamic information filter, wherein the controller powers the first light source, and energizes the active portion and the at least one information cell to allow the passage of light from the first light source through the at least one information cell.

3. The sign according to claim 1, further comprising:

a light pipe disposed between the first light source and the dynamic information filter, wherein a receiving surface of the light pipe is disposed adjacent to the first light source and an emitting surface of the light pipe is disposed adjacent to the dynamic information filter, whereby the light pipe receives the first light from the first light source and illuminates the light pipe in the first color.

4. The sign according to claim 3, wherein the active portion covers the entire emitting surface.

5. The sign according to claim 3, wherein the active portion does not cover the entire emitting surface of the lightpipe, thereby exposing an inactive portion of the lightpipe.

6. The sign according to claim 3, further comprising:

a partial information filter disposed over the inactive portion of the lightpipe, wherein the partial information filter includes at least one inactive information port, whereby the lightpipe is visible through the inactive information port when the lightpipe is illuminated.

7. The sign according to claim 2, wherein the dynamic information filter is a liquid crystal display.

8. The sign according to claim 1, further comprising:

a partial information filter including at least one information port disposed adjacent to the dynamic information filter, wherein the light from the first light passes through the inactive information port when the first light is illuminated.

9. The sign according to claim 1, wherein the dynamic information filter is a liquid crystal display panel.

10. The sign according to claim 6, further comprising:

a mechanical clock including an hour hand and a minute hand disposed through the light pipe, whereby viewers may discern the time from the hands of the mechanical clock.

11. The sign according to claim 7, wherein the at least one information cell is a liquid crystal display cell that is translucent when energized by the controller.

12. The sign according to claim 11, wherein the at least one information cell is opaque when not energized by the controller, whereby light from the first light source does not pass through the dynamic information filter when the dynamic information filter is not energized.

13. The sign according to claim 11, wherein the at least one information cell is of a prescribed shape to deliver visual information when the at least one information cell is energized.

14. The sign, according to claim 2, wherein the controller includes a timing function to derive real-time.

15. The sign according to claim 14, further comprising:

at least one additional information cell in electrical communication with the controller, wherein the controller controls the energizing of the at least one additional information cell.

16. The sign according to claim 15, wherein the information cells form a digital representation of a clock face including an hour hand and a minute hand, and the controller utilizes the timing function to energize the information cells required to deliver a real-time to viewers.

17. The sign according to claim 15, wherein the information cells form a representation of a digital clock face, and the controller utilizes the timing function to energize the information cells required to deliver an accurate time, whereby viewers may read a correct time.

18. The sign according to claim 2, further comprising:

a second light source in electrical communication with the controller, wherein the controller delivers power to the second light source to illuminate the second light source, and further wherein the second light source is disposed in proximity to the first light source, thereby delivering a second light to the dynamic information filter.

19. The sign according to claim 18, wherein the second light is of a different color than the first light source, and the controller phases the lights from the first color to the second color.

20. The sign according to claim 18, wherein the controller holds on a preselected color.

21. The sign according to claim 2, further comprising:

a light pipe disposed between the dynamic information filter and the first light source, whereby the first light source illuminates the light pipe in the first color, and further wherein the light pipe is visible through the at least one information cell of the dynamic information filter when the controller energizes the at least one information cell.

* * * * *